US006108392A

United States Patent [19]

Yoshizawa et al.

[11] Patent Number: 6,108,392

[45] Date of Patent: Aug. 22, 2000

[54] FUEL ASSEMBLY TRANSPORT CONTAINER AND METHOD OF TRANSPORTING A FUEL ASSEMBLY

[75] Inventors: Hiroyasu Yoshizawa, Ohmiya; Tamotsu Ozawa, Chigasaki; Satoshi Hirayama, Mito, all of Japan

[73] Assignee: Kabushiki Kaisha Toshiba, Kawasaki, Japan

[21] Appl. No.: 09/010,115

[22] Filed: Jan. 21, 1998

[30] Foreign Application Priority Data

| | | | |
|---|---|---|---|
| Jan. 21, 1997 | [JP] | Japan | P.9-008777 |
| Feb. 17, 1997 | [JP] | Japan | P.9-032087 |
| Feb. 28, 1997 | [JP] | Japan | P.9-045211 |

[51] Int. Cl.[7] ..... G21C 19/00

[52] U.S. Cl. ..... 376/272; 376/261; 250/506.1; 250/507.1

[58] Field of Search ..... 376/261, 272, 376/362, 364; 250/506.1, 507.1

[56] References Cited

U.S. PATENT DOCUMENTS

| | | | |
|---|---|---|---|
| 4,636,351 | 1/1987 | Rohr | 376/272 |
| 4,680,159 | 7/1987 | Lahr et al. | 376/272 |
| 4,708,845 | 11/1987 | Mildrum et al. | 376/435 |
| 5,035,342 | 7/1991 | Houghton | 220/23.2 |
| 5,262,133 | 11/1993 | Matthews | 376/272 |
| 5,263,064 | 11/1993 | Sappey | 376/272 |
| 5,481,117 | 1/1996 | Gilmore et al. | 376/272 |
| 5,894,134 | 4/1999 | Kissinger | 250/506.1 |

FOREIGN PATENT DOCUMENTS

| | | |
|---|---|---|
| 0 128 236 | 12/1984 | European Pat. Off. . |
| 0 506 512 | 9/1992 | European Pat. Off. . |
| 62-12899 | 1/1987 | Japan . |
| 2-222866 | 9/1990 | Japan . |

*Primary Examiner*—Michael J. Carone
*Assistant Examiner*—Fredrick T. French, III
*Attorney, Agent, or Firm*—Oblon, Spivak, McClelland, Maier & Neustadt, P.C.

[57] ABSTRACT

In a transport container, at least one fuel assembly is housed in a container having an inner surface portion to be fit to the at least one fuel assembly. The inner surface portion has a predetermined shape substantially corresponding to a fit portion of the at least one fuel assembly. The at least one fuel assembly is pushed against the inner surface portion of the container along a fixedly support direction. Therefore, the fit portion of the at least one fuel assembly is fit to the inner surface portion of the container so that the at least one fuel assembly is fixedly supported to the container.

22 Claims, 22 Drawing Sheets

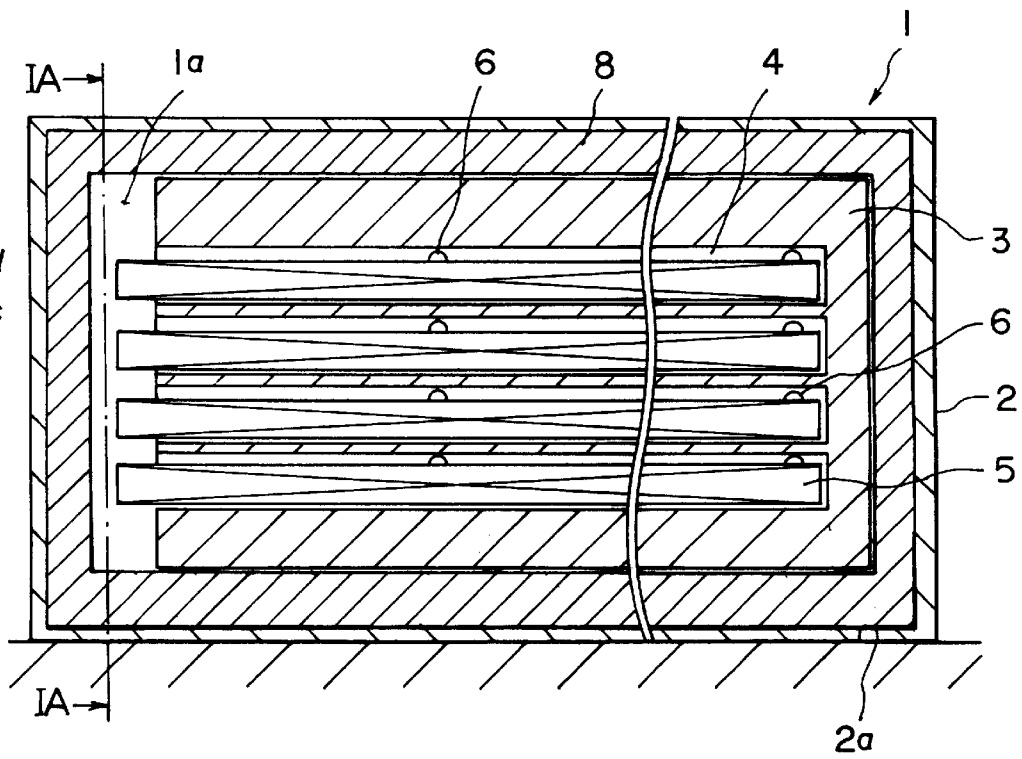
FIG. IB
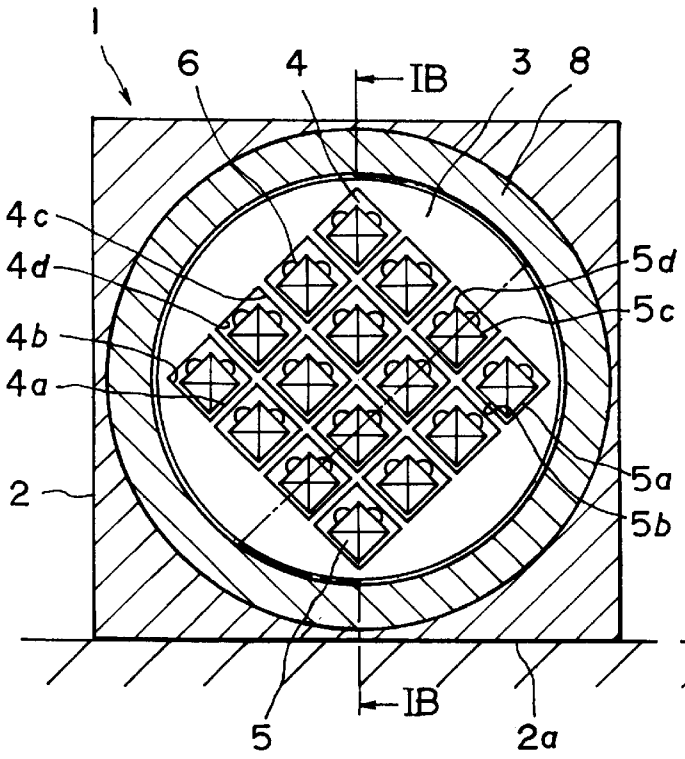
FIG. IA

FUEL ASSEMBLY TRANSPORT CONTAINER AND METHOD OF TRANSPORTING A FUEL ASSEMBLY

BACKGROUND OF THE INVENTION

1. Field of the Invention

The present invention relates to a transport container of a fuel assembly of a light water reactor such as a boiling water reactor (hereinafter, referred simply to as BWR), a pressurized water reactor (hereinafter, referred simply to as PWR) or the like, and to a method of transporting the fuel assembly thereof. In particular, the present invention relates to a fuel assembly transport container and a fuel assembly transport method, which can transport the fuel assembly itself or a fuel protective container housing the fuel assembly while fixedly supporting a motion of the fuel assembly or the fuel protective container.

2. Description of the Prior Art

A vibration generated in transporting a fuel assembly of a light water reactor such as BWR, PWR or other similar reactors, is a factor of causing wear in a metallic contact portion of the fuel assembly. In the fuel assembly, a spent fuel assembly has no problem as to somewhat of wear caused during transport because a waste disposal of the spent fuel assembly, reprocessing thereof and the like are carried out.

Therefore, there is no need of subjecting a transport container of the spent fuel assembly to specific vibration measures for preventing vibrations of the fuel assembly, and the spent fuel assembly may be transported in a state of being safely accommodated in the transport container. As a result, in order to house a plurality of spent fuel assembly, a transport container, which has a large capacity and is compact in its structure, has been used.

On the other hand, in the case of a transport container of a fuel assembly which is not used yet, since the fuel assembly is mounted to a reactor so that an operation of the reactor is carried out, it is very important that wear and damage should not be caused in a metallic contact portion or other similar portions of the fuel assembly which is not used yet by the vibration thereof during transporting the fuel assembly to the reactor, a store house or the like. So, when transporting the fuel assembly, a transport container of the fuel assembly is subjected to specific measures for preventing vibrations of the fuel assembly so that a reliability is maintained in the fuel assembly and a reactor using the fuel assembly.

For preventing a vibration of the fuel assembly, there is a need of housing the fuel assembly in a fuel protective container (also, called as an inner container of a fuel transport container) in a state that a motion of the fuel assembly is fixedly supported, and further, housing the fuel protective container housing the fuel assembly in a basket of the transport container while fixedly supporting a motion of the fuel protective container.

Here, FIGS. 25A and 25B show a conventional fuel protective container housing a fuel assembly in a state that the fuel assembly is fixedly supported.

A fuel assembly 101 is constructed in the following manner. Specifically, a plurality of fuel rods are tied up in a bundle with a metallic upper tie-plate 102 which has a relatively large-mass and is situated on an upper portion when the fuel assembly 101 is accommodated in a reactor, and with a metallic lower tie-plate 103 which has a relatively large-mass and is situated on a lower portion when the fuel assembly 101 is accommodated in a reactor. The lower tie-plate 103 has step portions tapered toward the crosswise inner peripheral side surfaces 106*c*, 106*c* which are opposite each other, described hereinafter.

This fuel assembly 101 has a square pillar shape having a square shape in its lateral cross section, and has a length of one side of the square cross section is substantially 4m in a longitudinal direction of the fuel assembly 101. Further, bundled fuel rods (fuel rod group) constituting the fuel assembly 101 are supported by means of a fuel spacer 104 with a predetermined interval.

A fuel protective container 105 comprises a container main body 106 having a substantially U shape in its lateral cross section, a cap member 107 which is detachably mounted on an upper portion (opening portion) of the container main body 106 which is transporting so as to cover the opening thereof, and protective members 108*a*~108*d*. The protective members 108*a*, 108*b*, 108*c* and 108*d* are formed along a bottom surface 106*a* of the container main body 106 along the horizontal direction when the container main body 106 is transported, longitudinally inner peripheral side surfaces 106*b*; 106*b* facing each other, crosswise inner peripheral side surfaces 106*c*; 106*c* which are opposite each other, and a lower surface 107*a* on the container main body side of the cap member 107, respectively. The fuel assembly 101 is accommodated in a fuel assembly housing space defined by the container main body 106 of the fuel protective container 105 and the cap member 107 so that the longitudinal direction of the fuel assembly 101 is parallel to the aforesaid horizontal direction during the transport of the container main body 106.

In order to prevent a vibration when transporting the fuel protective container 105 in which the fuel assembly 101 is housed, several sets of transport (fastening) separators 110 are interposed between the fuel spacers 104, between the fuel spacer 104 and the upper tie-plate 102, and between the fuel spacer 104 and the lower tie-plate 103. These separators are arranged so that gaps between the separators and the protective members 108*b* mounted on the longitudinal inner peripheral side surfaces 106*b*; 106*b* are formed.

That is, after the fuel assembly 101 is housed in the container main body 106, when the opening side upper portion of the container main body 106 is covered by the cap member 107 so as to be closed, the fuel assembly 101 is pressed down along an up and down direction (vertical direction) during the transport of the fuel assembly 101 by a fastening force of the cap 107 to the bottom surface 106*a* of the container main body 106 via the transport separator 110, and thus, is fixedly restricted therein. The fuel assembly 101 housed integrally with the fuel protective container 105 is transported while being fixedly supported by the fastening force via the transport separators arranged between the bottom surface 106*a* of the container main body 106 and the cap 107.

However, in the aforesaid conventional fuel protective container 105 in which the fuel assembly 101 is fixedly supported, the fuel assembly 101 is merely fixedly supported by fastening the fuel assembly 101 from the vertical direction. As shown in FIGS. 25A and 25B, the fuel assembly 101 is not clamped in the horizontal direction along th e crosswise direction. For this reason, the gap still exists between both sides of the fuel assembly 101 and the protective member 108*b* formed on the longitudinal inner peripheral side surf aces 106*b*, 106*b* of the container main body 106.

As a result, there is the possibility that the fuel assembly 101 slides and moves on the protective member 108*a* formed on the bottom surface 106*a* of the container main body 106 along the aforesaid crosswise (lateral) direction.

In this case, as a power of resistance to a relatively sliding motion between the fuel assembly 101 and the protective member 108*a* formed thereon, there is recited the weight of the fuel assembly 101 and a frictional force between the fuel assembly 101 and the protective member 108*a* based on a fastening force by the cap 107.

However, in the above power of resistance, concerning the fastening force by the cap member 107 recited as the frictional force, since the fastening portion is the transport separator 110 inserted into the fuel assembly 101, a compressive rigidity is small. When a great fastening force is applied on the transport separator 110, there is the possibility that the fuel assembly 101 is deformed; for this reason, a satisfied fastening force has not been provided by the cap member 107 on the transport separator 110. Therefore, concerning the frictional force resulting from the fastening force, a satisfied frictional force capable of preventing the sliding motion of the fuel assembly 101 has not been provided.

Consequently, because a tightly restricting force of the fuel assembly 101 is short in the horizontal direction along the longitudinal direction with respect to the fuel protective container 105, there has arisen a problem that the fuel assembly 101 moves (vibrates) while sliding in the fuel protective container 105 according to a vibration of the horizontal direction of a relatively high acceleration during the transport of fuel protective container 105.

In addition, a fastening force to the fuel assembly 101 is short in the horizontal direction along the longitudinal direction (axial direction) of the fuel assembly 101. Therefore, for example, in the case where a mixed-oxide fuel (MOX) assembly mixing a plutonium oxide ($PuO_2$) and an uranium oxide ($UO_2$) is used as the fuel assembly, during transport of the MOX fuel assembly, the MOX fuel assembly 101 is exothermic, and then, an elongation difference is caused due to a difference in thermal expansion between the MOX fuel assembly 101 and the fuel protective container 105. For this reason, a relatively positional shift is generated between the MOX fuel assembly 101 and the fuel protective container 105. In addition, a gap is defined between both end portions along the longitudinal direction (axial direction) of the MOX fuel assembly 101 and both side surfaces 106*c* of the fuel protective container 105 and between the MOX fuel assembly 101 and the bottom surface 106*a* of the fuel protective container 105.

As a result, similar to the aforesaid case of the horizontal direction along the crosswise direction, there is the possibility that the fuel assembly 101 slides and moves (vibrates) on the protective member 108*a* formed on the bottom surface 106*a* of the container main body 106 along the longitudinal direction according to a vibration of the horizontal direction of relatively high acceleration which arises from transporting the fuel protective container 105.

Moreover, in the conventional fuel protective container 105 in which the fuel assembly 101 is fixedly supported, since the fuel assembly 101 is fixedly supported by means of the transport separators 110 located between the fuel spacers 104, between the fuel spacer 104 and the upper tie-plate 102, and between the fuel spacer 104 and the lower tie-plate 103, a tightly fixing force is short in the attachment portions of the upper tie-plate 102 and the lower tie-plate 103 on both ends of the fuel assembly 101 in the longitudinal direction thereof. Therefore, resulting from mass of the upper tie-plate 102 and the lower tie-plate 103, there is the possibility that a remarkably different vibration is generated between the upper tie-plate 102 and the protective barrier 106 and between the lower tie-plate 103 and the same as compared with a vibration in the central portion of the fuel assembly 101 according to the aforesaid vibration of the horizontal direction during transport of the fuel protective container 105.

As described above, because the tightly fixing force in the horizontal direction is short or the tightly fixing force on portions locating the upper and lower tie-plates 102 and 103 is short, the fuel assembly 101 has slid and vibrated in the fuel protective container 105 housing the fuel assembly 101. This sliding vibration of the fuel assembly 101 causes a problem of accelerating awear of the metallic contact portion of the bundled fuel rods group.

Furthermore, in the conventional fuel protective container 105 in which the fuel assembly 101 is fixedly supported, the fuel assembly 101, that is, the weight of fuel rods group is supported by the transport separators 110. As a result, most of the own weight of fuel rods group are supported by a row of the fuel rods (the lowest row) which is closest to the bottom surface 106*a* of the fuel protective container 105 in the fuel rod groups.

For this reason, in a transport process of the fuel assembly 101, when a transport container housing the fuel assembly 101 is loaded and unloaded with the use of a crane (hoist) or other similar machines, in the case where an instantaneous force having a relatively high acceleration is applied to the fuel assembly 101, there is the possibility that the fuel rods situated on the lowest row are elastically deformed. This causes a problem that a loading and unloading condition during transport of the fuel assembly 101 must be strictly limited.

In particular, in a future fuel assembly, there is a tendency for a diameter of a fuel rod to be shortened. For this reason, there is the possibility that the loading and unloading restraint condition during the fuel assembly transporting process becomes further strict in future. Thus, it has been desired to present a proposal to immediately solve the above problem according to the deformation of the fuel assembly.

On the other hand, the fuel assembly has a long one side whose length is substantially 4 m in the longitudinal direction thereof; for this reason, vibration is not sufficiently prevented only by fixedly supporting both side portions of the fuel protective container in the longitudinal direction thereof. Therefore, in order to fixedly support the fuel protective container housing the fuel assembly in a basket of a transport container, there is a need of fixedly supporting an intermediate portion of the fuel protective container in the longitudinal direction thereof. However, specific fixedly supporting means for protecting the aforesaid fuel protective container has not been conventionally developed.

Especially, the case of transporting the transport container which houses a plurality of fuel protective containers in the basket of the transport container, the fixedly supporting means basically needs to be provided for each fuel protective container. However, conventionally, there is no existence of a small-size fixedly supporting means having a small spatial occupancy, and a spatial ratio occupied by the fixedly supporting means is large. This is the greatest factor obstructing development of a compact and large-capacity fuel transport container.

Further, in the case where the MOX fuel assembly is used as the fuel assembly, since the MOX fuel assembly is exothermic during the transport of the MOX fuel assembly so that a temperature of the fuel protective container 105 becomes high, fixedly supporting means need to be provided in order to maintain a high reliability under such a high temperature condition. However, there is a problem that fixedly supporting means having a high reliability under the high temperature condition has not been developed conventionally.

Furthermore, according to the prior art, a plurality of fuel protective containers are fixedly supported in the basket of the transport container for each fuel protective container. For this reason, when the plurality of fuel protective containers are fixedly supported, manpower and time is much spent in accordance with the number of the fuel protective containers. Therefore, there has been strongly desired a development of a transport container having fixedly supporting means which is capable of reducing manpower and easily and fixedly supporting a plurality of fuel protective containers in a basket of the transport container in a short time.

SUMMARY OF THE INVENTION

The present invention is directed to overcome the foregoing problems. Accordingly, it is a first object of the present invention to provide a transport container of a fuel assembly and method of transporting the fuel assembly , which can prevent the fuel assembly from being slid and vibrated in an interior of a fuel protective container by improving (reinforcing) a tightly fixing (restricting) force of the horizontal direction along a crosswise direction and a longitudinal direction of the fuel assembly housed in the fuel protective container and a tightly fixing force of portions locating upper and lower tie-plates even if a relatively large-level vibration is generated during transporting the fuel protective container, making it possible to stably transport the fuel assembly.

Further, a second object of the present invention is to provide a transport container of a fuel assembly and method of transporting the fuel assembly which can maintain a safety of a fuel assembly even in the case where a relatively high-acceleration instantaneous force is applied to the fuel assembly.

Furthermore, a third object of the present invention is to provide a transport container of a fuel assembly and method of transporting the fuel assembly having fixedly supporting means which includes a small size and a low spatial occupancy, and is excellent in reliability under a high temperature condition thereby making the transport container compact and reducing the fixedly restriction work of the fuel assembly.

To achieve the such objects, according to one aspect of the present invention, there is provided a transport container having at least one fuel assembly element including at least one fuel assembly for transporting the fuel assembly element, the transport container comprising container means having an inner surface portion to be fit to the at least one fuel assembly element for housing the at least one fuel assembly element, said inner surface portion having a predetermined shape substantially corresponding to a fit portion of the at least one fuel assembly element; and support means for pushing the at least one fuel assembly element against the inner surface portion of the container means along a fixedly support direction so as to fit the fit portion of the at least one fuel assembly element to the inner surface portion of the container means thereby fixedly supporting the at least one fuel assembly element to the container means.

This aspect of the present invention has an arrangement that the container means is provided with a basket including at least one basket hole having the inner surface portion, said at least one basket hole having four inner side surfaces providing a substantially square-shaped cross section, said at least one fuel assembly element includes at least one fuel protective container in which the at least one fuel assembly is housed, said at least one fuel protective container having four outer side surfaces providing a substantially square-shaped cross section and being housed in the at least one basket hole so that the four outer side surfaces of the at least one fuel protective container are opposite to the four inner side surfaces of the at least one basket hole, respectively, said inner surface portion is formed by two inner side surfaces of the four inner side surfaces of the at least one basket hole which are adjacent each other so as to be shaped as a substantially V, said two inner side surfaces being set according to the fixedly support direction, and wherein said fit portion of the at least one fuel assembly element includes a corner portion defined by the two outer side surfaces of the four outer side surfaces of the at least one fuel protective container so as to be fitted in the V shaped inner surface portion.

In preferred embodiment of this aspect, when the transport container is positioned along a horizontal plane in order to transport the transport container, the one of the two inner side surfaces of the at least one basket hole is inclined at a predetermined angle with respect to the horizontal plane or the one of the two inner side surfaces of the at least one basket hole is positioned along the horizontal plane.

This aspect of the present invention has an arrangement that the support means is located so as to be interposed between the remaining two outer side surfaces of the four outer side surfaces of the at least one fuel protective container and the remaining two inner side surfaces of the four inner side surfaces of the at least one basket hole and is in contact with the remaining two outer side surfaces and the remaining two inner side surfaces so as to push the at least one protective container against the V shaped inner surface portion thereby fixedly supporting the corner portion of the at least one fuel protective container to the V shaped inner surface portion thereof.

In the preferred embodiment of this aspect, the basket has a substantially cylindrical shape and plurality of the basket holes arranged as a square shape and is divided into a plurality of basket portions in a longitudinal direction of the basket, said support means has a grid plate having substantially square shaped grid holes of a same arrangement as the plurality of basket holes, said grid plate being interposed between at least one adjacent basket portion and said at least one fuel protective container being inserted in at least one of the basket holes and at least one of the grid holes corresponding to the at least one of the basket holes and has a drive device for moving the grid plate along a diagonal direction of the at least one of the basket holes toward the V shaped inner surface portion thereof so as to push the at least one fuel protective container against the V shaped inner surface portion of the at least one of the basket holes thereby fixedly supporting the corner portion of the at least one fuel protective container to the V shaped inner surface portion thereof.

This aspect of the present invention has an arrangement that the basket has a substantially cylindrical shape and plurality of the basket holes arranged as a square shape and is divided into a plurality of basket portions in a longitudinal direction of the basket, said support means has a pair of grid plates arranged so as to face each other each of which has substantially square shaped grid holes of a same arrangement as the plurality of basket holes, each of said grid plates being interposed between at least one adjacent basket portions and said at least one fuel protective container being inserted in at least one of the basket holes and at least one of the grid holes of each of the grid plates corresponding to the at least one of the basket holes and has a drive device for moving one of the grid plates along the one of the two inner side surfaces of the at least one of the basket holes toward the other of the two inner side surfaces thereof and moving the other of the grid plates along the other of the two inner side surfaces thereof toward the one of the two inner side surfaces thereof so as to push the at least one fuel protective container against the V shaped inner surface portion of the at least one of the basket holes thereby fixedly supporting the corner portion of the at least one fuel protective container to the V shaped inner surface portion thereof.

In order to achieve the such objects, according to another aspect of the present invention, there is provided a method of transporting at least one fuel assembly element including at least one fuel assembly, the method comprising the steps of providing a transport container including a basket which has at least one basket hole having an inner surface portion to be fit to the at least one fuel assembly element, said inner surface portion having a predetermined shape substantially corresponding to a fit portion of the at least one fuel assembly element; housing the at least one fuel assembly element in the at least one basket hole of the basket so that the fit portion of the at least one fuel assembly element is opposite to the inner surface portion of the at least one basket hole; and pushing the at least one fuel assembly element against the inner surface portion of the at least one basket hole along a fixedly support direction so as to fit the fit portion of the at least one fuel assembly element to the inner surface portion of the at least one basket hole thereby fixedly supporting the at least one fuel assembly element to the basket.

In order to achieve the such objects, according to further aspect of the present invention, there is provided a method of transporting at least four fuel assemblies, the method comprising the steps of preparing at least one fuel protective container capable of housing at least four assemblies, housing the at least four fuel assemblies in the at least one fuel protective containers, preparing a transport container in which a basket is housed, said basket including at least one basket hole which is capable of accommodating the at least one fuel protective container and which has an inner surface portion to be fit to the at least one fuel protective container, said inner surface portion having a predetermined shape substantially corresponding to a fit portion of the at least one fuel protective container, housing the at least one fuel protective container in the at least one basket hole so that the fit portion of the at least one fuel protective container is opposite to the inner surface portion of the at least one basket hole and pushing the at least one fuel protective container against the inner surface portion of the at least one basket hole along a fixedly support direction so as to fit the fit portion of the at least one fuel assembly element to the inner surface portion of the at least one basket hole thereby fixedly supporting the at least one fuel assembly element to the basket.

In order to achieve the such objects, according to further aspect of the present invention, there is provided a method comprising the steps of providing a transport container including a basket which has a plurality of basket holes arranged as a predetermined shape for housing at least one fuel assembly element in one of the basket holes, each of said basket holes being provided with an opening end portion preparing a fixing plate having a plurality of holes of a same arrangement as the plurality of basket holes attaching the fixing plate to the opening end portion of the basket holes so as to be detachable therefrom, said at least one fuel assembly element being housed in at least one of the basket holes and at least one of the holes of the fixing plate mounting a project portion on a position of the at least one fuel assembly element so that the project portion projecting toward the at least one of the basket holes, said mounted position of the at least one fuel assembly element being opposite to the opening end portion of the at least one of the basket holes and pushing the fixing plate against the project portion of the at least one fuel assembly element so as to fixedly support the at least one fuel assembly element to the fixing plate.

In the above aspects of the present invention, the at least one fuel assembly element having a fit portion (corner portion) defined by two outer side surfaces thereof is pushed by the support means against the inner surface portions constituting the V shaped portion of the at least one basket hole of the basket which is opposite to the corner portion so that the corner portion of the at least one fuel assembly element is fit to the V shaped portion of the at least one basket hole whereby the at least one fuel assembly element is fixedly supported to the at least one basket hole of the basket.

Therefore, the own weight of the fuel assembly element housing the fuel assembly is supported by the V shaped portion of the at least one basket hole of the basket and the movement of the at least one fuel assembly element is fixedly restriction by the supporting means, making it possible to prevent the at least one fuel assembly element from being slid and vibrated and to stably transport the fuel assembly element.

BRIEF DESCRIPTION OF THE DRAWINGS

Other objects and aspects of the present invention will become apparent from the following description of embodiments with reference to the accompanying drawings in which:

FIG. 1A is a cross sectional view of a fuel transport container having a basket which is shown by arrows substantially along a line IA—IA of FIG. 1B according to a first embodiment of the present invention;

FIG. 1B is a cross sectional view of the fuel transport container shown by arrows substantially along a line IB—IB of FIG. 1A;

DETAILED DESCRIPTION OF THE PREFERRED EMBODIMENTS

The preferred embodiments of the present invention will be described hereinafter with reference to the accompanying drawings.

Figure 25A:
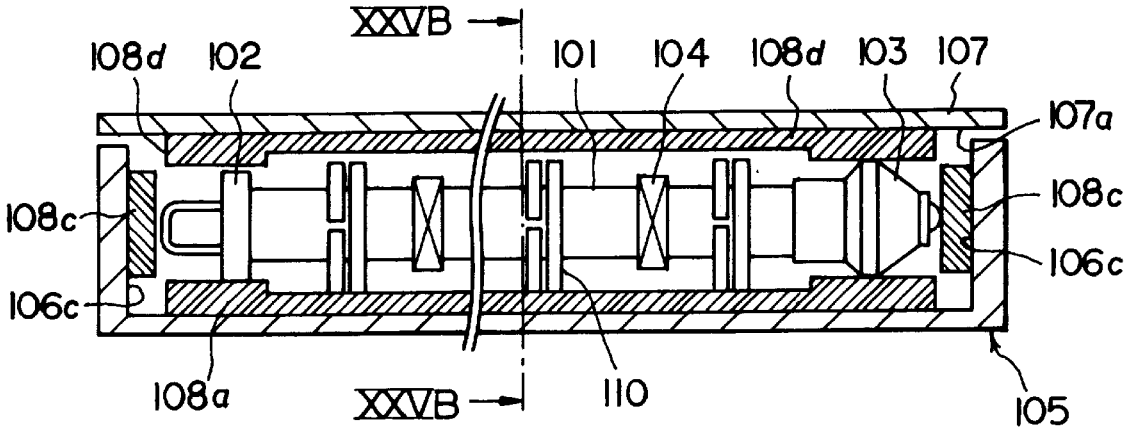
FIG. 25A PRIOR ART
FIG. 25A is a cross sectional view showing a construction of a conventional fuel protective container.
Figure 25B:
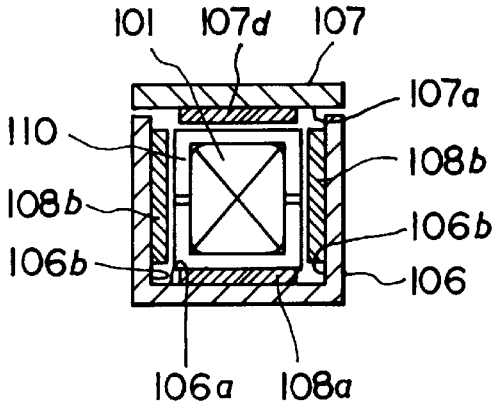
FIG. 25B PRIOR ART
FIG. 25B is a cross sectional view taken on line XXVB—XXVB of FIG. 25A.

Moreover, reference characters of the preferred embodiments which are identical to the previously described prior art shown in FIGS. 25A and 25B are substantially given same reference characters. Therefore, description of the reference characters of the preferred embodiments which are identical to the previously described prior art shown therein are omitted or simplified.

According to a first embodiment of the present invention, FIG. 1A is a cross sectional view of a fuel transport container having a basket which is shown by arrows substantially along a line IA—IA of FIG. 1B and FIG. 1B is a cross sectional view of the fuel transport container shown by arrows substantially along a line IB—IB of FIG. 1A. As shown in FIG. 1A and FIG. 1B, the fuel transport container 1 which is loaded onto at least one of various transport means, for example, a truck (container car), a freightliner (container ship), or the like has a substantially square pillar shaped frame 2 having a square shape in its lateral cross section. The frame 2 has a bottom surface 2*a* which is placed on a load bed (load place surface) of the transport means and which is positioned along a substantially horizontal direction when the fuel transport container 1 is transported by the transport means. The fuel transport container 1 has a first inner hollow cylindrical chamber in which a basket fixing container (outer container 8 having a second inner hollow cylindrical chamber 1*a* is coaxially housed and arranged.

The fuel transport container 1 includes a basket 3 which has a cylindrical shaped outline and is fixedly housed in the inner hollow cylindrical chamber 1*a* of the basket fixing container 8. The basket 3 is provided with a plurality of basket holes 4. Each of the basket holes 4 having one end portion which is bottom and other end portion which is opening. Each of the basket holes 4 is formed by an inner peripheral wall portion having four inner peripheral side surfaces 4*a*, 4*b*, 4*c* and 4*d* and inner peripheral bottom surface and has a substantially square pillar shape wherein a shape in lateral direction of each basket holes 4 is substantially square. The inner peripheral side surface 4*a* which is adjacent to the inner peripheral side surfaces 4*b* and 4*c* is connected therewith and is opposite to the inner peripheral side surface 4*d* which is adjacent to the inner peripheral side surfaces 4*b* and 4*c* and which is connected therewith.

The basket 3 is adapted to be accommodated and adapted in the inner hollow cylindrical chamber 1*a*, when the fuel transport container 1 is transported by the transport means and the bottom surface 2*a* of the fuel transport container 1 is horizontally positioned along the horizontal direction, so that one of the two inner peripheral side surfaces 4*a*, 4*b* of each of the basket holes 4 is inclined at a predetermined angle with respect to the bottom surface 2*a* corresponding to a horizontal plane. In this embodiment, the predetermined angle is set as substantially 45° so that a groove portion defined by the inner peripheral side surfaces 4*a*, 4*b* which are closely located to the bottom surface 2*a* are formed as a substantially V shape.

Each of a plurality of fuel protective containers 5 has four outer side surfaces 5*a*, 5*b*, 5*c* and 5*d* providing a substantially square pillar shape wherein a shape in lateral direction of each protective containers 5 is substantially square. The outer side surface 5*a* which is adjacent to the outer side surfaces 5*b* and 5*c* is connected therewith and is opposite to the outer side surface 5*d* which is adjacent to the outer side surfaces 5*b* and 5*c* and which is connected therewith.

Each of the fuel protective containers 5 is housed in the respective basket holes 4 so that a corner portion formed by the outer side surfaces 5*a*, 5*b* which are opposite to the inner peripheral side surfaces 4*a*, 4*b*, respectively is fitted in the groove portion formed by the inner peripheral side surfaces 4*a*, 4*b* so that the weight of each of the fuel protective containers 5 is supported by the inner peripheral side surfaces 4*a*, 4*b*. A predetermined gap is defined between the upper-side inner peripheral side surfaces 4*c*, 4*d* which are closely located to a top surface of the basket 2 and the upper-side outer side surfaces 5*c*, 5*d* of each of the fuel protective containers 5 which are opposite to the inner peripheral side surfaces 4*c*, 4*d*.

A fixedly supporting device 6 is located at plural portions of the outer side surfaces 5*c*, 5*d* of each of the protective containers 5 in a longitudinal direction thereof so as to be interposed in the predetermined gap. Each of the fixedly supporting device 6 is in contact to the inner peripheral side surfaces 4*c*, 4*d* and the outer side surfaces 5*c*, 5*d* so as to push each of the protective containers 5 downward along the vertical direction against the inner peripheral side surfaces 4*a*, 4*b* of each of the basket holes 4 so that the fuel protective containers 5 are fixedly supported to the basket holes 4 of the basket 3, respectively.

Each of a fuel assembly 101 is housed in respective fuel protective containers 5.

As the fixedly supporting device 6, at least one of a small spring member, a protrusion member having a shape which is easy to be slid, a rotating roller member or other similar restricting members is provided on the outer side surfaces 5*c*, 5*d* of the fuel protective container 5 which has been housed in the basket hole 2.

Further, the fixedly supporting device 6 may be provided on the inner peripheral side surfaces 4*c*, 4*d* of the basket hole 4 housing the fuel protective container 5. Furthermore, a fixedly supporting device which is shown in modifications of the first embodiment and in embodiments after a second embodiment may be employed.

Figure 2:
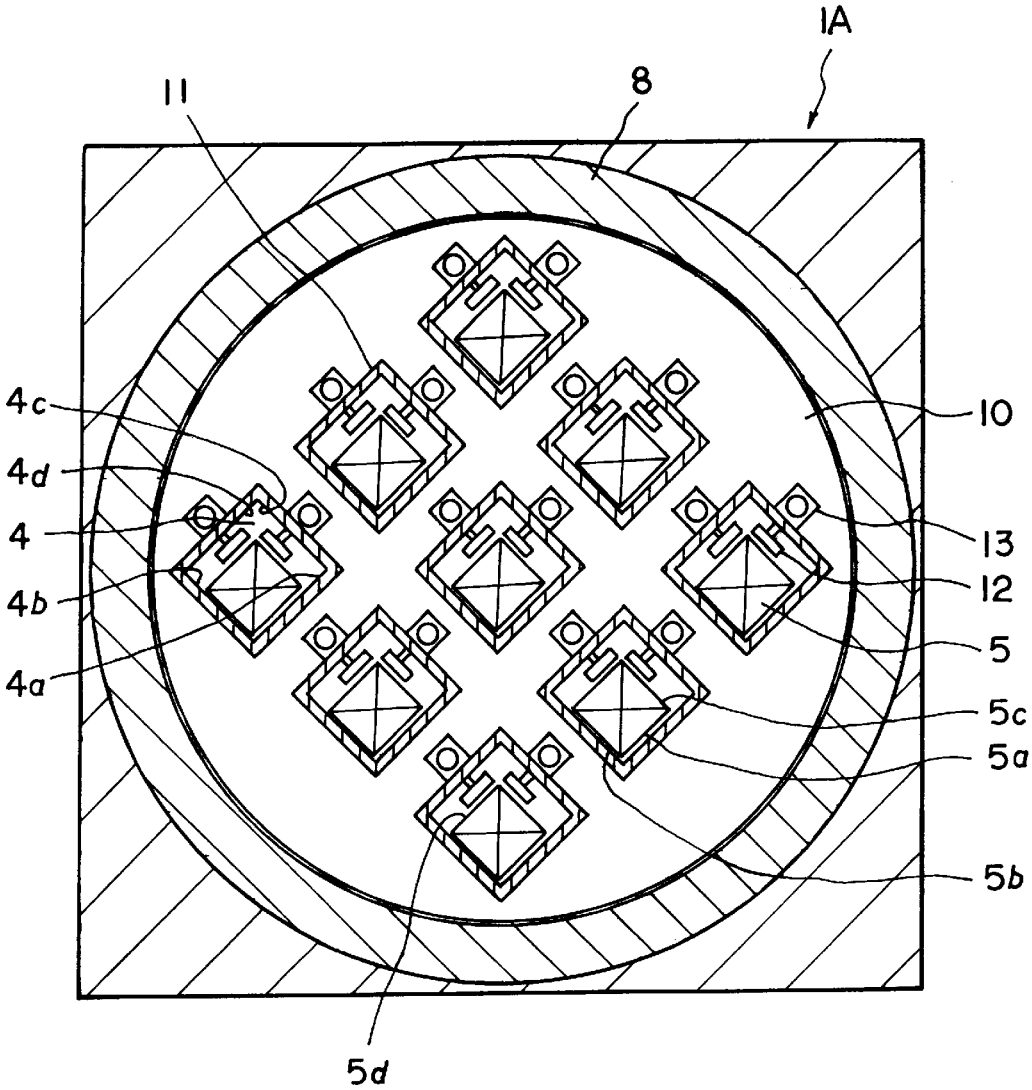
FIG. 2 is a cross sectional view of the fuel transport container according to a modification of the first embodiment.

In modification of the first embodiment, as shown in FIG. 2, a basket 10 of the fuel transport container 1A is fabricated into a cylindrical shape in the following manner. Specifically, a plurality of long boxes or rectangular tubes 11 (hereinafter, this long boxes or rectangular tubes is called rectangular tube 11) having a square shape in its lateral cross section are arranged with a predetermined interval so as to form a substantially square, and then, these rectangular tubes 11 is combined by a joining member (not shown).

In this case, an interior of the rectangular tube 11 is equivalent to the aforesaid basket hole 4, and four inner surfaces of a plate constituting of the rectangular tube 11 is equivalent to the aforesaid inner surfaces 4*a*, 4*b*, 4*c* and 4*d* of the basket hole 4.

In the same as the first embodiment, one of the two inner peripheral side surfaces of each of the basket holes is inclined at a predetermined angle with respect to the bottom surface 2*a* corresponding to the horizontal plane. In this embodiment, the predetermined angle is set as substantially 45° so that a groove portion formed by the inner peripheral side surfaces 4*a*, 4*b* which are closely located to the bottom surface 2*a* is formed as a substantially V shape. Each of the fuel protective containers 5 is housed in the respective basket holes 4 so that a corner portion formed by the outer side surfaces 5*a*, 5*b* which are opposite to the inner peripheral side surfaces 4*a*, 4*b*, respectively is fitted in the groove portion formed by the inner peripheral side surfaces 4*a*, 4*b*. A fixedly supporting device 12 is located at plural portions of the outer side surfaces 5*c*, 5*d* of each of the protective containers 5 in a longitudinal direction thereof so as to be interposed in the predetermined gap. Each of the fixedly supporting device 12 is in contact to the inner peripheral side surfaces 4*c*, 4*d* of the respective holes 4 and the outer side surfaces 5*c*, 5*d* of the respective protective containers 5 so as to press the respective protective containers 5 against the inner peripheral side surfaces 4*a*, 4*b* by a drive of a drive mechanism 13 so that the fuel protective containers 5 are fixedly supported to the basket holes 4 of the basket 3, respectively.

Figure 3A:
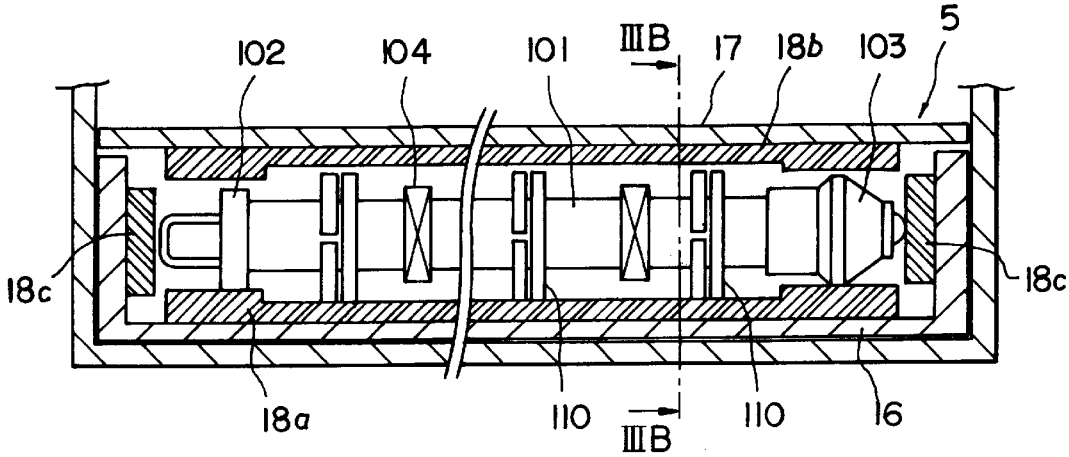
FIG. 3A is a cross sectional view taken on line IIIA—IIIA of FIG. IIIB according to the first embodiment.

Meanwhile, as shown in FIG. 3A, for preventing a vibration when transporting the fuel protective container 5 in which the fuel assembly 101 is housed, the several transport separators 110 is interposed between the fuel spacers 104, between the fuel spacer 104 and the upper tie-plate 102, and between the fuel spacer 104 and the lower tie-plate 103.

Figure 3B:
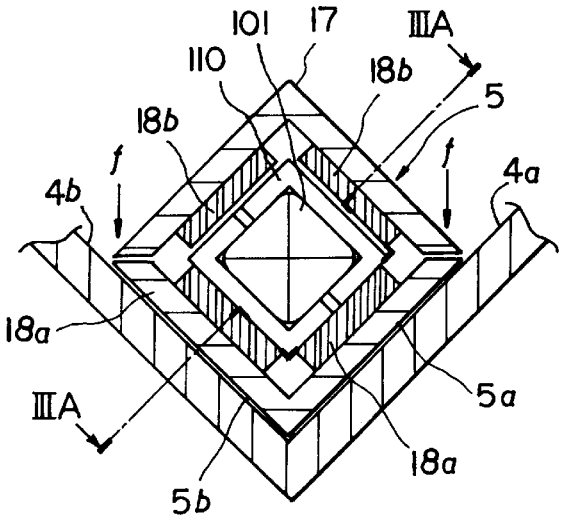
FIG. 3B is a cross sectional view taken on line IIIB—IIIB of FIG. IIIA according to the first embodiment.

As shown in FIGS. 3A and 3B, the fuel protective container 5 comprises a container main body 16 having the lower-side inner surfaces 4*a*, 4*b* and having a substantially V shape in its lateral cross section so that the corner portion of the V shaped main body 16 projects toward the bottom surface 2*a* of the frame 2 of the fuel transport container 1, a cap member 17 which has the upper-side inner surfaces 4*c*, 4*d* and is mounted on an upper portion (opening portion) of the container main body 16 which is opposite to the corner portion thereof so as to be detachable to the upper portion of the container main body 16 and to cover the upper portion thereof and protective members 18*a*~18*c* which are formed along lower-side inner surfaces of the fuel protective container 5, along upper-side inner surfaces thereof and along crosswise inner peripheral side surfaces of the container main body 16.

Since the fuel assembly 101 is housed in the fuel protective container 5 and the corner portion formed by the outer side surfaces 5*a*, 5*b* of the fuel protective container 5 is fitted in the groove portion formed by the inner peripheral side surfaces 4*a*, 4*b* one of which is inclined at a predetermined angle, for example 45° with respect to the bottom surface 2*a* corresponding to the horizontal plane, one of the side surfaces of the fuel assembly 101 which is in contact with the one of the side surfaces 4*a*, 4*b* is inclined at the predetermined angle of 45° with respect to the bottom surface 2*a* corresponding to the horizontal plane.

Here, as one example, there is shown the fuel protective container 5 in which protective members 18*a*~18*d* such as plastic, rubber, honeycomb or the like are provided on the inner surfaces of the fuel protective container 5, respectively.

The fuel assembly 101 is housed in the container main body 16, and thereafter, is fastened from an upper side of the container main body 16 by means of a fastening force f of the cap member 17 which is caused by the supporting device 6 and the like via the protective member 18*b*. In this case, portions where the fastening force is applied are the transport separator 110, the upper tie-plate 102 and the lower tie-plate 103.

Next, the following is an explanation about an operation and effect obtained from the aforesaid construction of the transport container 1 and a method of transporting the fuel transport container 1 in which the fuel assembly 101 is housed. First, a process for housing the fuel assembly 101 is carried out in the following manner. As shown in FIG. 1A and FIG. 1B, the fuel assembly 101 such as the MOX fuel assembly or the like is housed in the fuel protective container 5 which is provided with the fixedly supporting device 6 comprising, for example, a spring member expanded above located at plural portions of the outer side surfaces 5*c*, 5*d* of the protective container 5 in the longitudinal direction thereof.

The transport container 1 having the basket 3 which is provided with the basket holes 4 is prepared. The basket 3 is arranged in the outer container 8 of the transport container 1 so that one of the two inner peripheral side surfaces 4*a*, 4*b* of each of the basket holes 4 is inclined at the predetermined angle of 45° with respect to the bottom surface 2*a*.

Subsequently, a mount process is carried out in the following manner. While mounting the fuel protective container 5 to the basket 3 of the transport container 1, the basket 3 of the transport container 1 is previously situated in a vertically positioned state wherein the bottom surface 2*a* of the transport container 1 is positioned along a vertical direction, the fuel protective container 5 is hoisted and put down from the upper portion of the vertically positioned basket 3 of the transport container 1 so as to be housed in the basket hole 4 thereof. After, all of the fuel protective containers 5 are housed in the basket holes 4, the transport container 1 in which all fuel protective containers 5 are housed is located so that the bottom surface 2*a* of the transport container 1 is laterally positioned along the horizontal direction when the fuel transport container 1 is transported.

Therefore, assuming that when the fuel transport container 1 is horizontally positioned at the lateral position of the transport state, one of the two inner peripheral side surfaces 4*a*, 4*b* of each of the basket holes 4 is inclined at the predetermined angle of 45° with respect to the bottom surface 2*a*, the fixedly supporting device 6 provided at each fuel protective containers 5 to be housed in the respective basket holes 4 is situated so as to face the upper-side inner peripheral side surfaces 4*c*, 4*d* of the respective basket holes 4 when the fuel transport container 1 is situated at the lateral position.

As a result of that, when the fuel transport container 1 is horizontally positioned, the fuel protective containers 5 are housed in the basket holes 4, respectively so that the corner portion formed by the outer side surfaces 5*a*, 5*b* which are opposite to the inner peripheral side surfaces 4*a*, 4*b*, respectively is fitted in the groove portion formed by the inner peripheral side surfaces 4*a*, 4*b*, whereby right and left movement that is, movement along the laterally horizontal direction of the fuel protective container 5 is restricted, and the own weight thereof is supported in a state of dispersed.

Further, the fixedly supporting device 6 fixedly supports the fuel protective container 5 to the basket 3 of the fuel transport container 1 by urging the upper-side inner peripheral side surfaces 4*c*, 4*d* of the basket hole 4 and the upper-side outer side surfaces 5*c*, 5*d* of the protective container 5 against the inner peripheral side surfaces 4*a*, 4*b* of the basket hole 4 with a spring elasticity. Thus, the movement of each of the fuel protective containers 5 housed in the respective basket holes 4 is restricted with respect to both a direction perpendicular to the longitudinal direction and the longitudinal direction.

Although not shown, in the case where the aforesaid fixedly supporting device 6 is provided on the inner peripheral side surfaces 4*a*, 4*b*, when the fuel protective container 5 is housed in the basket 3, there is no need of taking a directional position with respect to the basket hole 4 into consideration; therefore, workability can be improved.

Therefore, the aforesaid manner, in the transport process of the fuel transport container 1, the own weight of the fuel protective container 5 housing the fuel assembly 101 such as the MOX fuel assembly or the like is supported by the groove portion having the V shape formed by the inner peripheral side surfaces 4*a*, 4*b*. Further, the fuel protective container 5 is fixedly supported so that its motion in the basket hole 4 is restricted by the fixedly supporting device 6 provided between its upper-side outer side surfaces 5*c*, 5*d* and the upper-side inner peripheral side surfaces 4*c*, 4*d* of the fuel protective container 5. Then, in such the fixedly supported state, the fuel protective container 5 is transported to various district atomic power facilities including an atomic power station (plant) by various transport means, for example, a truck, a freighter or the like. That is, the fuel protective container 5 is transported with one of the two outer side surfaces 5*a*, 5*b* thereof kept being inclined to the horizontal surface at the predetermined angle of 45°.

In this case, the V shaped basket groove portion formed by the inner peripheral side surfaces 4*a*, 4*b* of the basket hole 4 of the fuel transport container 5 and the fixedly supporting device 6 stably supports the fuel protective container 5 with respect to a vibration during transport. In particular, the fuel protective container 5 is stably supported with respect to a lateral acceleration in the cross section. In addition, even if an acceleration of gravity (1G) or more is generated, the fuel protective container 5 can be transported in a state of being prevented from jumping up in the basket hole 4 by means of the aforesaid fixedly supporting device 6.

As seen from the above description, according to the first embodiment, the fixedly supporting device 6 is a small size, so that the fuel transport container 5 can be made into a compact size together with the basket 3 of the fuel transport container 1. Thus, a plurality of fuel protective containers 5 can be housed and transported with a high safety. Therefore, a fuel transport container having a large capacity can be readily provided.

Further, a work for fixedly supporting the fuel protective container 5 housed in the basket 3 of the fuel transport container 1 is reduced because the fuel protective container 5 is fixedly supported by means of the fixedly supporting device 6 only by housing the fuel protective container 5 in the basket 3 of the fuel transport container 1. Therefore, it is possible to reduce manpower and easily and fixedly support the plurality of the fuel protective containers in a short time, thereby realizing a work saving of the transport of the fuel assembly.

Moreover, according to the first embodiment, the square-shaped fuel assembly 101 is placed on the protective member 18*a* on the bottom side of the V-shaped groove portion of the container main body 16, and is fastened from the upper side of the fuel assembly 101 by means of the V-shaped cap member 17. Thus, it is possible to remarkably improve (or reinforce) a horizontally tightly fixing force with respect to the fuel protective container 5 of the fuel assembly 101 as compared with the prior art.

In addition, in the basket 10 of the fuel transport container 1A according to the modification shown in FIG. 2, the fixedly supporting device 13 is provided on the inner peripheral side surfaces 4*c*, 4*d* of the rectangular tube 11. Thus, when the fuel protective container 5 is housed in the basket 10 of the fuel transport container 1A, there is no need of taking a directional position with respect to the basket hole formed by the rectangular tube 11 into consideration. In addition, since the fuel transport method is the same as the case of FIG. 1, making it possible to obtain the same effects of the first embodiment.

Figure 4:
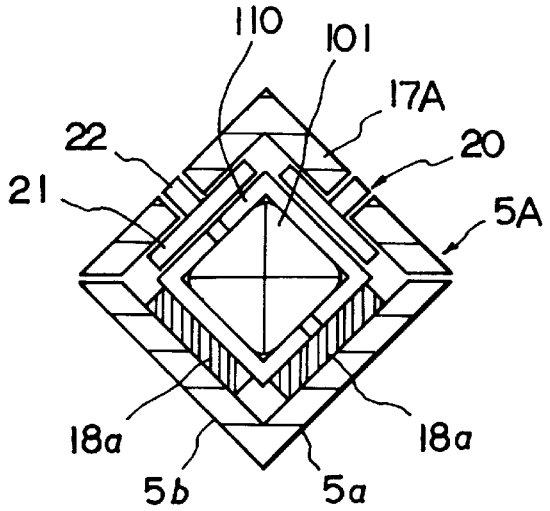
FIG. 4 is a cross sectional view showing a construction of a fuel protective container according to another modification of the first embodiment.

Moreover, FIG. 4 shows a construction of a fuel protective container 5A according to another modification of the first embodiment. As shown in FIG. 4, a square-shaped fuel assembly 101 is housed in the fuel protective container 5A which comprises the container main body 16 and a cap member 17A. Each of two inner peripheral side surfaces of the cap member 17A is provided with a fastening mechanism 20 which comprises a fastening plate 21 capable of moving close to the fuel assembly 101 and far therefrom and a movable mechanism 22 operatively connected to the fastening plate 21 capable of detecting a fastening torque and a fastening shift (or displacement) of the fastening plate 21 so as to press the fastening plate 21 according to the detected fastening torque and the detected fastening shift. The fuel assembly 101 is fastened from the upper side of the fuel assembly 101 by means of the fastening mechanism 20. In addition, description of the reference characters of the another modification which are identical to the previously described first embodiment shown in FIGS. 3A and 3B are omitted or simplified.

According to the above another modification, an arbitrary fastening force is loaded by means of the fastening mechanism 20 in accordance with a fastening portion of the fuel assembly 101, so that a tightly fixing force can be more securely provided.

Further, it is possible to perform a fastening force control (torque control) during transporting the fuel assembly 101, so that, in addition to the effects of the first embodiment, the fuel assembly 101 can be more safely transported.

Figure 5:
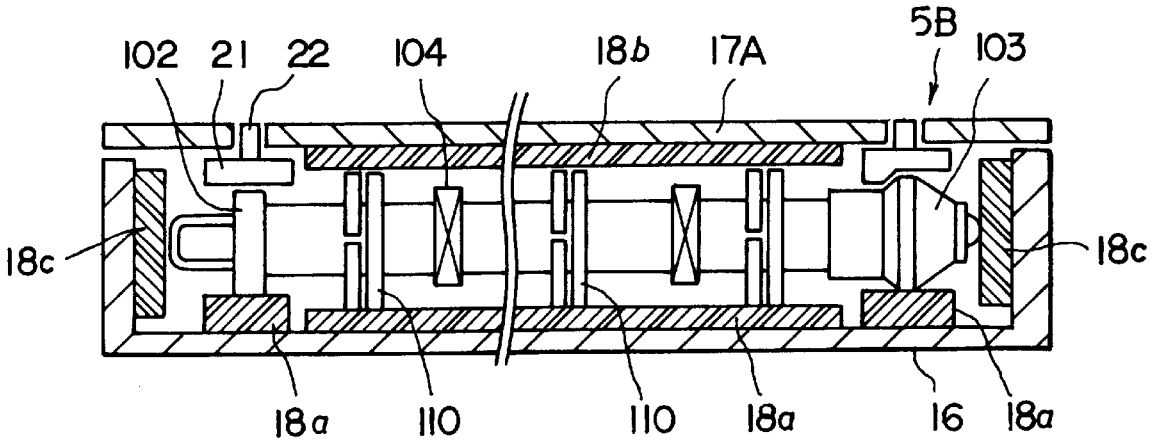
FIG. 5 is a cross sectional view showing a construction of a fuel protective container according to further modification of the first embodiment.

FIG. 5 further shows a construction of the fuel protective container 5B according to further modification of the first embodiment. As shown in FIG. 5, there are two portions for fastening the fuel assembly 101 by the fastening mechanism 20, that is, a portion of the upper tie-plate 102 and a portion of the lower tie-plate 103. A portion of the transport separator 110 is fastened by a fastening force of the cap member 17A.

In addition, description of the reference characters of the further modification which are identical to the previously described first embodiment and another modification shown in FIGS. 3A, 3B and 4 are omitted or simplified.

In general, the portion of the transport separator 110 has a low compressive rigidity. For this reason, relatively uniform fastening is realized by the fastening force of the cap member 17. On the contrary, the upper and lower tie-plates 102 and 103 individually have a very high compressive rigidity. Therefore, uniform fastening is not obtained from the fastening force of the cap member 17A.

However, according to the further modification of the first embodiment, the upper and lower tie-plates 102 and 103 individually have large mass, so that portion of these upper and lower tie-plates 102 and 103 having specific vibration characteristics can be fastened by a proper fastening force of the fastening mechanism 20. Thus, as the same with the effects obtained by the first embodiment and the another modification, the aforesaid specific vibration can be prevented.

Figure 6:
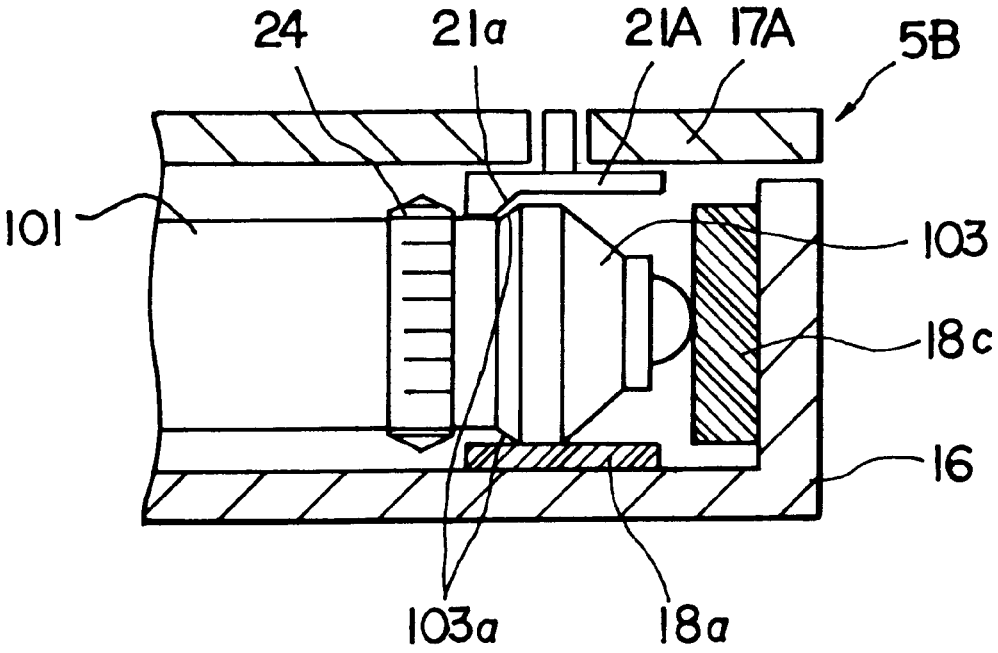
FIG. 6 is an enlarged cross sectional view showing a construction of the fuel protective container according to a further modification of the first embodiment.

In addition, in the further modification of the fuel protective container 5B, as shown in FIG. 6, at least one of the fastening plates 21A mounted on the lower tie-plate 103 in the fuel assembly 101 has a stepped plate portion 21*a* formed in correspondence to one of the step portions 103*a* of the lower tie-plate 103, which has a dimension such that the stepped plate portion does not contact with a finger spring 24 already provided on the lower tie-plate 103. The stepped plate portion 21*a* of the fastening plates 21A is arranged on the stepped portion 103*a* of the lower tie-plate 103 so that the stepped plate portion 21*a* is fitted to the stepped portion 103*a* of the lower tie-plate 103, whereby a displacement of the fuel assembly 101 is restricted by the lower tie-plate 103 in the axial direction thereof.

As seen from the above description, according to the modification shown in FIGS. 5 and 6, in addition to the effects obtained by the first embodiment and the another modification, the lower tie-plate 103 can prevent a slide of the fuel assembly 101 due to a vibration in the axial direction during transporting the fuel assembly 101, or a positional shift due to a difference in thermal expansion between the MOX fuel assembly 101 and the fuel protective container 5 during transporting the MOX fuel assembly.

Figures 7A, 7B, 7C:
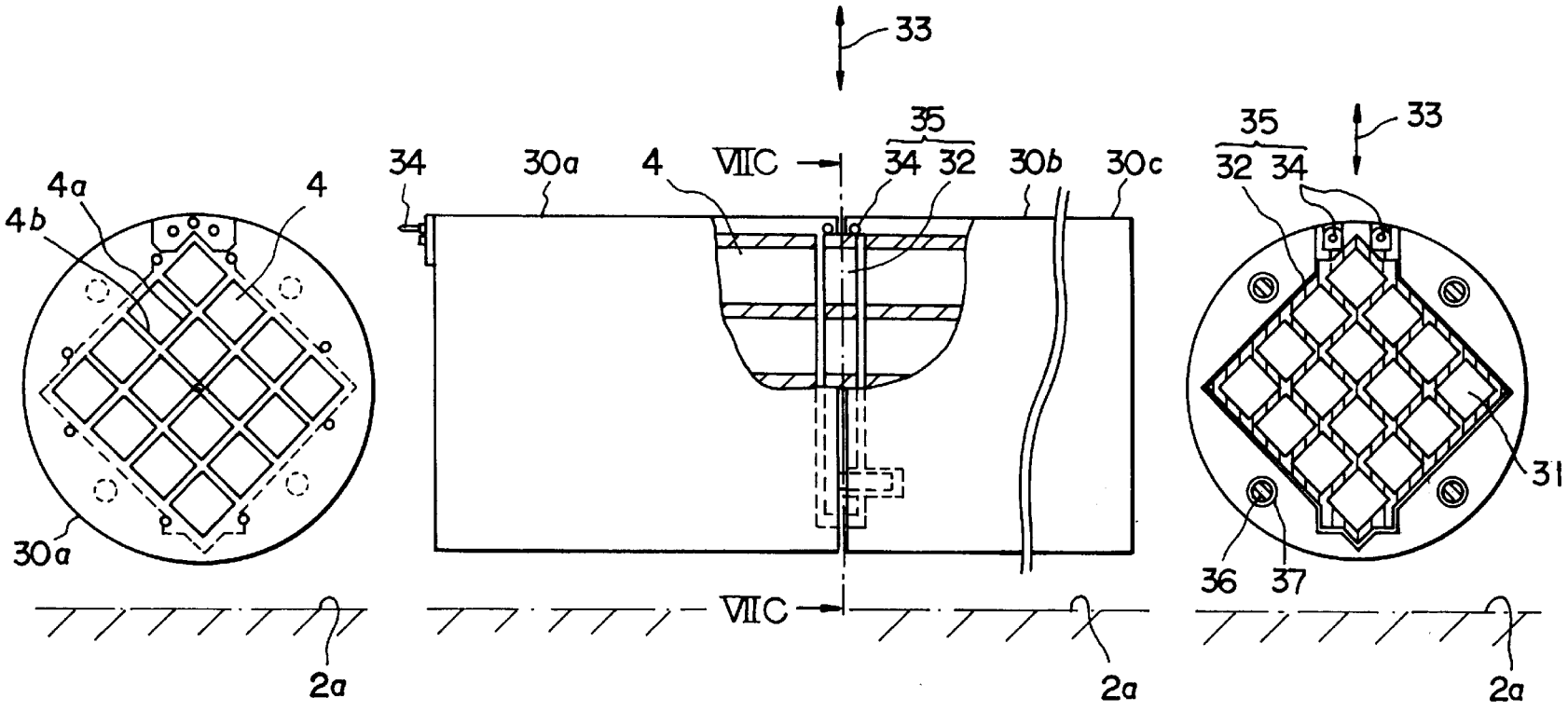
FIG. 7A is a partially cutaway side view of a basket of a fuel transport container according to a second embodiment of the present invention.
FIG. 7B is a front view of the basket of the fuel transport container shown in FIG. 7A according to the second embodiment of the present invention.
FIG. 7C is a cross sectional view cut along a line VIIC—VIIC in FIG. 7A.

According to a second embodiment of the present invention, FIG. 7A is a partially cutaway side view of a basket of a fuel transport container and FIG. 7B is a front view of the basket of the fuel transport container. In addition, description of the reference characters of the second embodiment which are identical to the previously described first embodiment and modifications thereof and are substantially given same reference characters of the first embodiment and the modifications thereof are omitted or simplified.

As shown in FIGS. 7A and 7B, a basket 30 of a fuel transport container has a plurality of basket holes 4 each of which is formed by four inner peripheral side surfaces 4*a*, 4*b*, 4*c* and 4*d* of the basket 3 and has a substantially square pillar shape wherein a shape in lateral direction of each basket holes 4 is substantially square.

When the fuel transport container is horizontally positioned, one of the lower side inner peripheral side surf aces 4*a*, 4*b* of each of the basket holes 4 is inclined at a predetermined angle, for example, substantially 45° with respect to the bottom surf ace 2*a* of the f uel transport container corresponding to the horizontal plane.

The basket 30 is divided into a plurality of portions in the longitudinal direction thereof. Specifically, the basket 30 is divided into a divisional basket top portion 30*a* which is the top portion when the fuel transport container is vertically positioned, divisional baskets 30*b*, 30*c* following the basket top portion, as the need arises.

In this embodiment, the basket 30 is adapted to be formed of three divisional baskets 30*a* to 30*c*, and the basket 30 will be described below.

As shown in a cross sectional view of FIG. 7C cut along a line VIIC—VIIC in FIG. 7A, a grid plate 32 having substantially a square shape and having substantially square shaped grid holes 31 of the same arrangement as the basket holes 4 is interposed between portions mutually joining end portions of respective divisional baskets 30*a* to 30*c*.

In order to stably move the square shaped grid plate 32 to the diagonal direction of the basket hole 4 and the protective container 5 (shown by an arrow 33), a fixedly supporting device 35 has a pair of drive mechanisms 34. The paired drive mechanisms 34 are provided on structurally symmetrical portions of an upper side portion of the grid plate 32. The symmetrical portions are symmetrical with respect to the cross section which crosses a center of a width of the grid plate 32 along a surface thereof. Each paired drive mechanisms 34 is provided on an outer peripheral vicinity of the basket 30. The grid plate 32 and the set of drive mechanisms 34 constitute a fixedly supporting device 35.

In the portions mutually joining end portions of respective divisional baskets 30*a* to 30*c*, one (divisional basket top portion 30*a*) is provided with a projecting joint cylinder 36 as a joint means; the other (divisional basket 30*b*) is formed with a joint hole 37. The fixedly supporting device 35 is interposed between portions mutually joining between respective divisional baskets 30*a* to 30*c*.

Further, the joint cylinder 36 of the divisional basket top portion 30*a* is fitted into the joint hole 37 of the divisional basket 30*b*. In the same manner, the divisional basket 30*b* and the divisional basket 30*c* are joined together, and these joint cylinder 36 and joint hole are fixed by known predetermined method (not shown). In this manner, the fuel transport container comprising the basket 30 which is provided with the fixedly supporting device 35 is constructed.

Next, the following is an explanation about an operation and effect obtained from the above construction of the basket 30 of the and a method of transporting the fuel transport container 1 having the basket 30 in which the fuel assembly 101 is housed.

First, the divisional basket 30*c*, the divisional basket 30*b* and the divisional basket top portion 30*a* are, in the named order, piled into a vertical state to assemble the basket 30 of the fuel transport container.

At this time, the grid plate 32 including the drive mechanisms 34, which functions as the fixedly supporting device 35, is interposed between portions mutually joining respective divisional baskets 30*a* to 30*c*.

When the fuel transport container is horizontally positioned at the lateral position of the transport state, the grid plate 32 is interposed so that one of the inner peripheral side surfaces 4*a*, 4*b* of the basket hole 4 is inclined at the angle of, for example, substantially 45° to the horizontal plane 2*a*, and so that the drive mechanism 34 of the fixedly supporting device 35 is situated on the upper portion of the basket 30.

Subsequently, in the mount process, the fuel protective container 5 housing the fuel assembly 101 such as the MOX fuel assembly is hoisted and put down so as to be inserted into the basket hole 4 of the basket 30 of the fuel transport container which is in the aforesaid vertical state.

At this time, the position of the holes 31 of the grid plate 32 corresponds previously to a position of the basket holes 4 so as not to be a hindrance when housing the fuel protective container 5.

At the point of time all of fuel protective containers 5 are completely housed in the basket 30, the drive mechanism 34 of the fixedly supporting device 35 is operated so as to move the grid plate 32 toward the bottom surface 2*a* of the basket hole 4 shown by the arrow 33 along the diagonal direction by a fixed displacement. At this time, right and left two drive mechanisms 34 which are structurally symmetrical portioned in the upper side portion of the grid plate 32, so that the grid plate 32 can be stably and smoothly moved along the diagonal direction.

Further, since the grid plate 32 is formed with the grid hole 31 having the same shape and arrangement as the basket hole 4, the grid plate 32 is moved along the diagonal direction of the cross section of the basket hole 4 whereby the fuel protective container 5 is pressed against the groove portion formed by the inner peripheral side surfaces 4*a*, 4*b* so that the fuel protective container 5 is fixedly supported to the basket hole 4 of the basket 3.

Figure 8A:
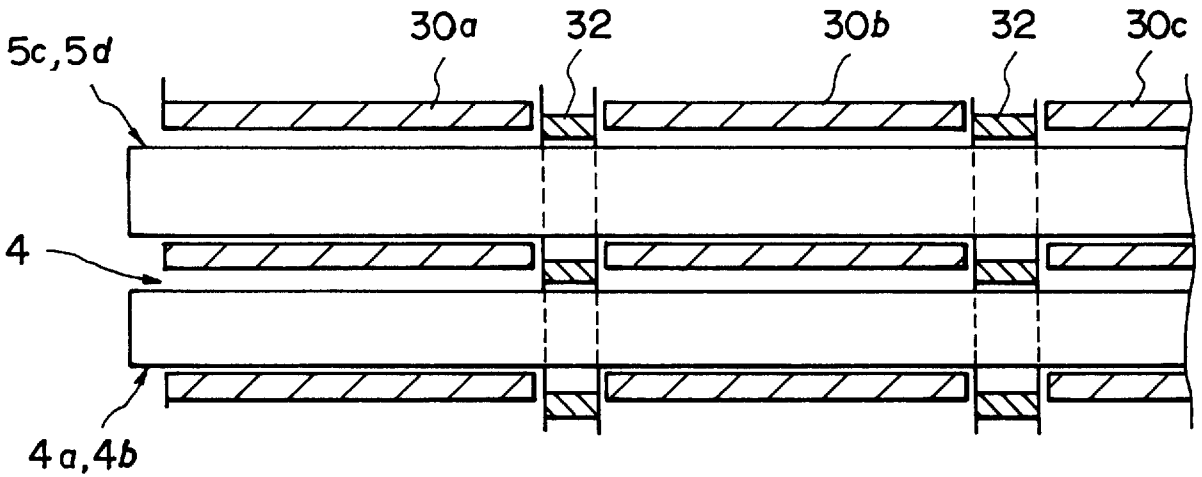
FIG. 8A is an enlarged side cross-sectional view of principal parts of FIG. 7A.
Figure 8B:
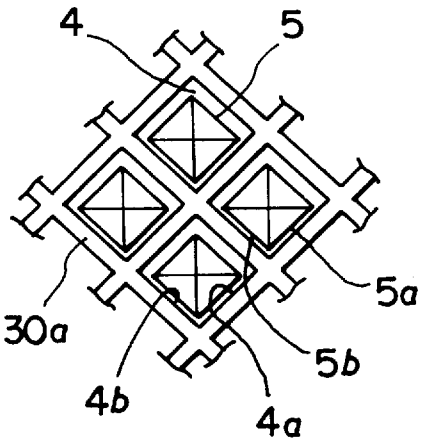
FIG. 8B is an enlarged side view of principal parts of FIG. 8A.

That is, as seen from FIG. 8A showing an enlarged side cross-sectional view of principal parts of FIG. 7A and FIG. 8B showing an enlarged side view of principal parts of FIG. 8A, when the fuel transport container is horizontally positioned, the lower-side outer surfaces 5*a*, 5*b* of each fuel protective containers 5 are supported on the aforesaid inner peripheral side surfaces 4*a*, 4*b* of the inner peripheral wall forming the V shaped groove portion while the upper-side outer surfaces 5*c*, 5*d* thereof being simultaneously pressed downward toward the bottom surface 2*a* by the grid plate 32.

Whereby the fuel protective container 5 housed in the basket hole 4 is fixedly supported in the basket 30, and further, a motion of the fuel protective container 5 is restricted in both a direction perpendicular to the longitudinal direction and the longitudinal direction.

Thus, in a transport process of the fuel transport container, the fuel protective container 5 housing the fuel assembly 101 such as the MOX fuel assembly is constructed so that the own weight thereof is supported by the V shaped groove formed by the inner peripheral side surfaces 4*a*, 4*b* while the upper-side outer side surfaces 5*c*, 5*d* thereof is pressed and supported by means of the grid plate 32 of the fixedly supporting device 35. Thus, the fuel protective container 5 is transported by various transport means in a state that its motion is restricted in the basket hole 4.

At this time, the V shaped groove formed by the inner peripheral side surfaces 4*a*, 4*b* and the fixedly supporting device 35 of the fuel transport container stably supports the fuel protective container 5 with respect to a vibration during the transport operation. In particular, all of the fuel protective containers 5 can be simultaneously fixedly supported only by the drive of the grid plate 32.

As a result of that, the fuel transport container is made into a compact size together with the basket 30, and can accommodate a plurality of fuel protective containers while being safely transported. Thus, this contributes to a large capacity and a reduction of a fixedly supporting work.

As described above, according to the second embodiment, the fixedly supporting device 35 is readily interposed between portions mutually joining the divisional baskets 30*a* to 30*c*, and has a small-sized shape. Therefore, the external appearance of the basket 30 does not need to be enlarged, so that the aforesaid first problem related to an enlargement of a basket can be solved.

Further, since the drive mechanisms 34 of the fixedly supporting device 35 are arranged on the upper portion of the basket 30 during the transport operation, each of the drive mechanisms 34 is hard to be under the influence of a rise of temperature of the basket 30 resulting from an exothermic reaction of the fuel assembly. Therefore, high reliability is obtained, so that the aforesaid second problem related to the rise of temperature can be solved.

Furthermore, all of fuel protective containers housed in the basket 30 are simultaneously fixedly supported by means of the grid plate 32 moved by an operation of the drive mechanisms 34 of the fixedly supporting device 35. Therefore, a fixedly supporting work is reduced, so that the aforesaid third problem regarding a saving of the support work of the fuel protective containers can be solved.

Figure 9:
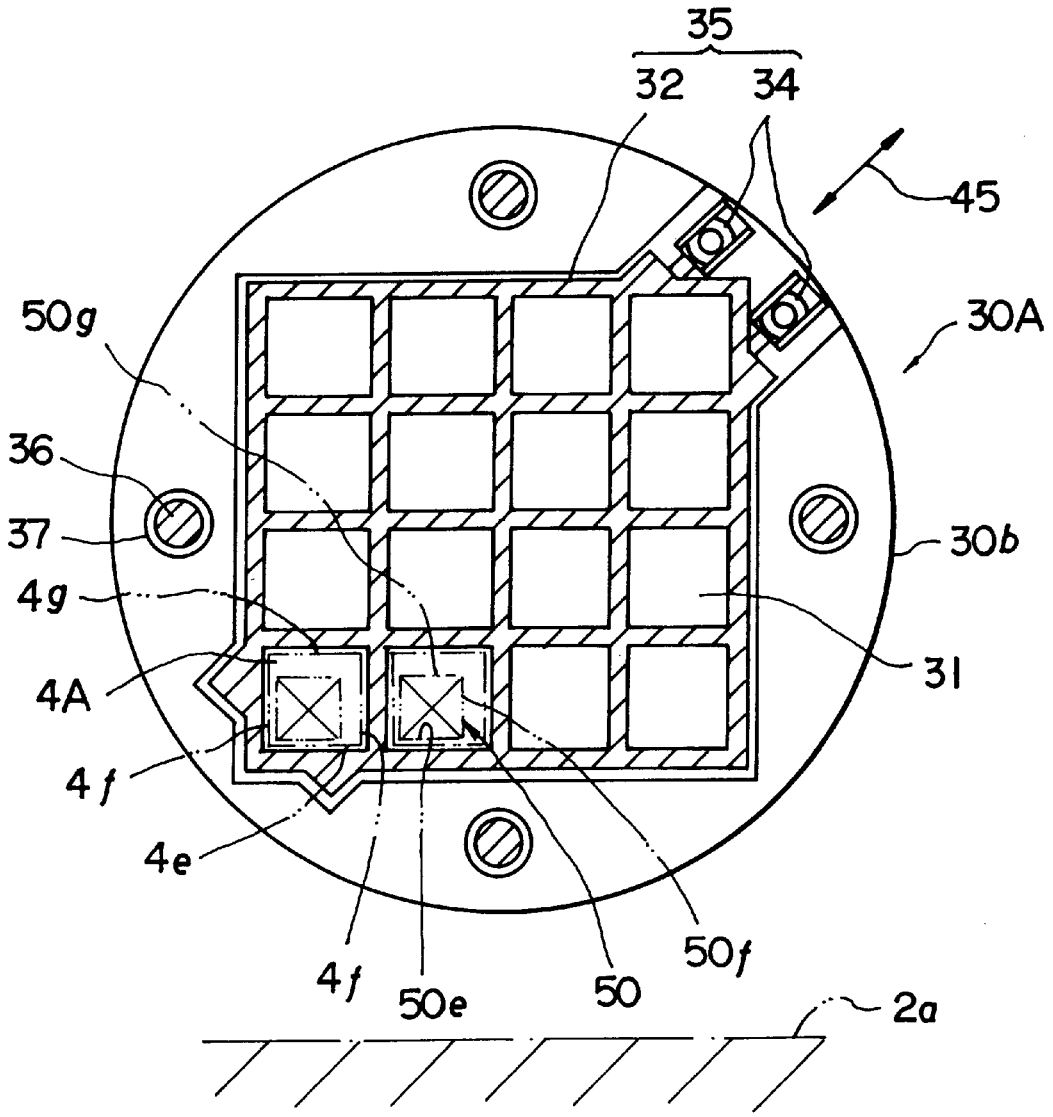
FIG. 9 is an enlarged front view showing a basket according to a third embodiment of the present invention.

FIG. 9 shows a third embodiment of the present invention. According to the third embodiment, a fixedly supporting device is the substantially same as that of the above second embodiment. For this reason, since the reference characters of the second embodiment which are identical to the previously described first embodiment and modifications thereof and are substantially given same reference characters of the second embodiment, a detailed explanation of components, operation and effect and a fuel transport method common to the second embodiment is omitted.

As shown in a front view of FIG. 9, the basket 30A of the fuel transport container is formed with a great may of basket holes 4A each of which is formed by an inner bottom surface 4*e* along the bottom surface 2*a* of the fuel transport container corresponding to the horizontal direction when the fuel transport container having the basket is horizontally positioned, two inner peripheral side surfaces 4*f* which are connected to the inner bottom surface 4*e* and faces each other and an inner top surface 4*g* which is connected to the inner peripheral side surfaces 4*f* and is opposite to the inner bottom surface 4*e*. Each of the basket holes 4A has a substantially square pillar shape wherein a shape in lateral direction of each basket holes 4A is substantially square. A fuel protective container 50 has an outer bottom surface 50*e*, two outer side surfaces 50*f* which are connected to the outer bottom surface 50*e* and faces each other and a outer top surface 50*g* which is connected to the outer side surface 50*f* and is opposite to the outer bottom surface 50*e*, the outer side surfaces 50*f* and the outer top surface 50*g* providing a substantially square shape wherein a shape in lateral direction of the fuel protective container 50 is substantially square. The fuel protective container 50 is housed in the basket hole 4A so that the outer bottom surface 50*e*, the outer side surfaces 50*f* and the outer top surface 50*g* are opposite to the inner bottom surface 4*e*, the inner side surfaces 4*f* and the inner top surfaces 4*g*, respectively.

This basket 30A is divided into plural portions 30*a*, 30*b* and 30*c* in the longitudinal direction thereof. In this embodiment, the divisional basket 30*b* is shown as an example.

A grid plate 32, which is formed with holes 31 having the same arrangement as the basket holes 4A, is interposed between portions mutually joining end portions of respective divisional baskets 30*a* to 30*c*.

In order to move the grid plate 32 to a direction (shown by an arrow 45) of substantially 45° to the horizontal direction, which is the diagonal direction of the cross section of the basket hole 4A, a fixedly supporting device 35 including two drive mechanism 34 are arranged on two portions structurally symmetrical on an obliquely upper side portion of the grid plate 32, is provided on the outer peripheral vicinity of the basket 30A. The symmetrical portions are symmetrical with respect to the cross section of the grid plate 32.

Further, in order to join divisional baskets 30*a* and 30*c*, the divisional basket 30*b* is provided the joint means shown in the above second embodiment, and then, these divisional baskets are joined together. Thus, a fuel transport container comprising the basket 30A which is provided with the fixedly supporting device 35 is constructed.

Figure 10:
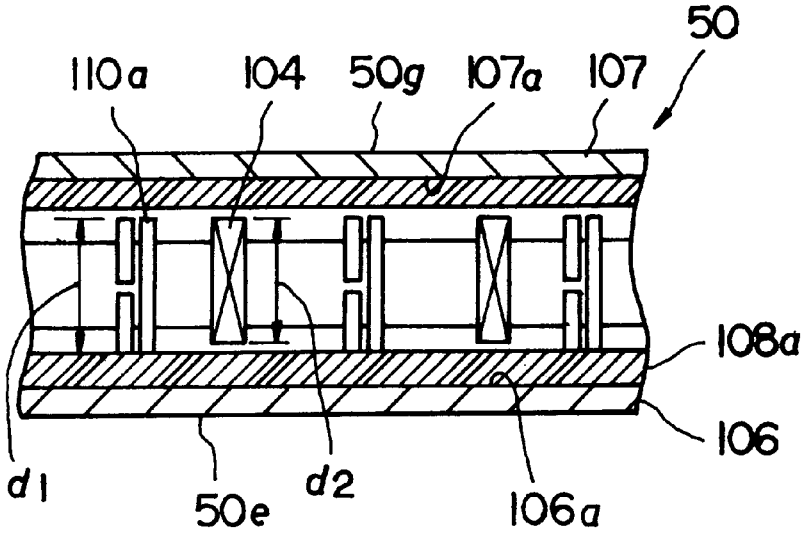
FIG. 10 is a cross sectional view showing a construction of the a protective container according to the third embodiment.

Meanwhile, as shown in FIG. 10, a fuel protection container 50 has the container main body 106 and the cap member 107. A transport separator 110*a* is attached to the fuel assembly 101 housed in the fuel protection container 50.

The transport separator 110*a* has an external dimension (i.e., a length on one side in the lateral direction) ranging from an external dimensional value of the fuel spacer to a value in which 1.2 mm is added to the external dimensional value. Further, the fuel assembly 101 is housed in the fuel protective container 50 in which a protective member 108*a*~108*d* attached to the inner peripheral surfaces 106*a*~106*c* of the container main body 106 and the lower surface 107*a* of the cap member 107 is flat.

The housed fuel assembly 101 is fixedly supported in the fuel protective container 50 in a state that the fuel spacer 104 and the transport separator 110*a* contact with the protective members 108*a*~108*d*, and then, is transported by the transport container (not shown).

When a relatively great instantaneous force is applied, this fuel protective container 105 is constructed so as to support the force by means of the fuel spacer 104 having a high strength. In this case, the transport separator 110*a*, which has an external dimension slightly larger than that of the fuel spacer 104, is used.

The aforesaid transport separator 110*a* is inserted to the fuel rod group between the fuel spacers 104; for this reason, the transport separator 110*a* has a small compressive rigidity and is easy to be deformed by compression.

Thus, in the fuel protective container 50 of this embodiment, even if the external dimension d1 of the transport separator 110*a* is substantially 1.2 mm larger than the external dimension d2 of the fuel spacer 104, the transport separator 105 is deformed without giving a damage to the fuel assembly 101 by the own weight of the fuel assembly 101 and the fastening force, and makes it possible to abut the fuel spacer 104 against the protective members 108*a*~108*d*.

Whereby the fuel spacer 104 can support a load by an instantaneously great acceleration generated in a work with the use of a crane or the like. Therefore, the fuel rods situated on the lowermost row can be prevented from being plastically deformed while the problem in the prior art being solved.

In the case where the external dimension d1 of the transport separator is substantially 1.2 mm larger than the external dimension d2 of the fuel spacer, when compressively deforming the transport separator 110*a* and abutting the fuel spacer 104 against the protective members 108*a* to 108*d*, there is the possibility that the fuel assembly 101 may be plastically deformed and consequently, may be broken down.

Next, the following is an explanation about an operation and effect obtained from the above construction of the fuel transport container having the basket 30A in which the fuel assembly 101 is housed and a method of transporting the fuel transport container having the basket 30A therein. In a mount process, the fuel protective container 50 housing the fuel assembly 101 such as the MOX fuel assembly is hoisted and put down so as to be housed in the basket hole 4A of the basket 30A of the fuel transport container which is in the vertical state.

At the point of time all of fuel protective containers 50 are completely housed in the basket 30A, the drive mechanisms 34 of the fixedly supporting device 35, which are structurally symmetrical positioned, are operated so as to move the grid plate 32 toward a corner portion formed by the inner bottom side surface 4*e* and one of the inner peripheral side surface 4*f* along the diagonal direction (shown by an arrow 45) by a fixed displacement.

As a result of that, all fuel protective containers 50 housed in the basket holes 4A are pressed against the V shaped corner portion formed by the inner bottom surface 4*e* and one inner side surface 4*f* of the basket holes 4A so that the fuel protective container 50 are fixedly supported on the V shaped corner portion thereof by the moving grid plate 32.

In the third embodiment, when the fuel transport container is horizontally positioned, the basket hole 4A supporting the own weight of the fuel protective container 50 is flat, and is not inclined unlike the above second embodiment. For this reason, in order to obtain a fixedly supporting effect same as the above second embodiment, a great drive force by the drive mechanism 34 is further required as a fixedly supporting force.

However, according to the third embodiment, the fixedly supporting device 35 is made into a small size, and there can be provided a fuel transport container which is compact and has a large capacity capable of housing a plurality of fuel protective containers 50. Therefore, a work for fixedly supporting the fuel protective containers 50 is greatly reduced together with the fuel transport method. Thus, the effect capable of solving the aforesaid problems is the same as the above second embodiment.

Figure 11:
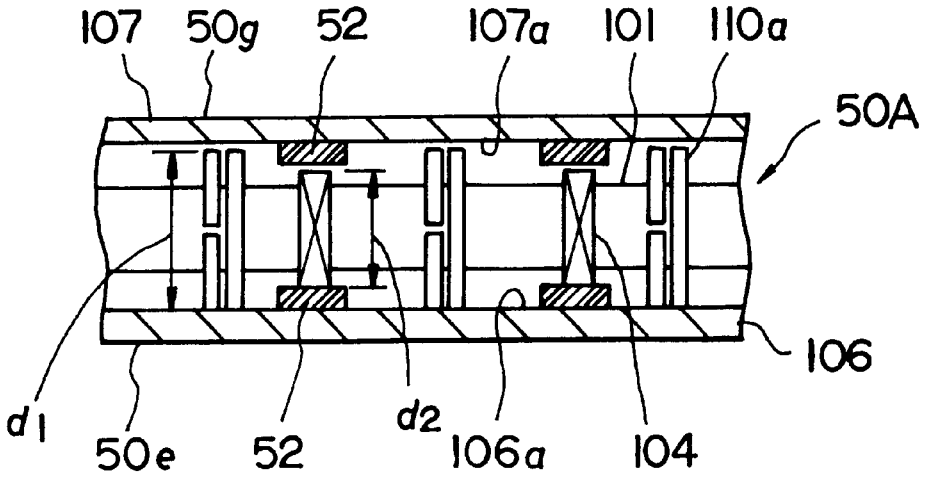
FIG. 11 is a cross sectional view showing a construction of a fuel protective container according to a modification of the third embodiment.

FIG. 11 shows a construction of a fuel protective container 50A according to a modification of the third embodiment. In FIG. 11, there is shown an example of the case where the external dimension d1 of the transport separator 110*a* is considerably larger than 1.2 mm as compared with the external dimension d2 of the fuel spacer 104.

In the case as described above, an intermediate member 52 is provided on a position where the fuel spacer 104 is situated on the inner peripheral surfaces 106*a* to 106*c* and 107*a* of the fuel protective container 50A in order to control a gap between the external dimension d1 of the transport separator 110*a* and the external dimension d2 of the fuel spacer 104.

Specifically, a plate thickness of the intermediate member 52 is selected so that the external dimension d1 of the transport separator 110*a* ranges from a value in which the external dimension d2 of the fuel spacer 104 and the plate thickness of the intermediate member 52 are added together to a value in which 1.2 mm is added to the aforesaid value.

According to this modification of the third embodiment, the fuel spacer 104 supports a load with respect to a force of instantaneously great acceleration, so that the fuel rods situated on the lowermost row can be prevented from being plastically deformed.

Figure 12A:
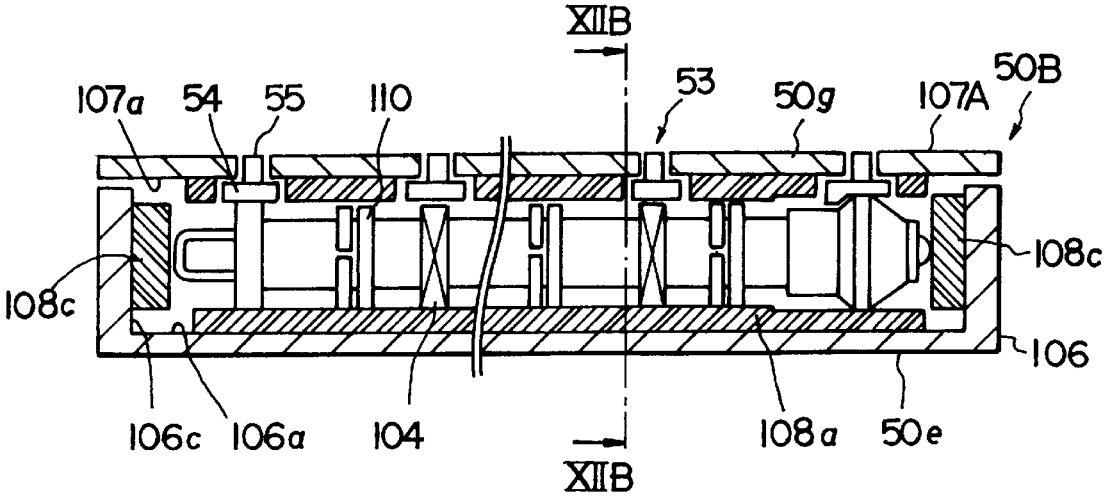
FIG. 12A is a cross sectional view showing a construction of a fuel protective container according to another modification of the third embodiment.
Figure 12B:
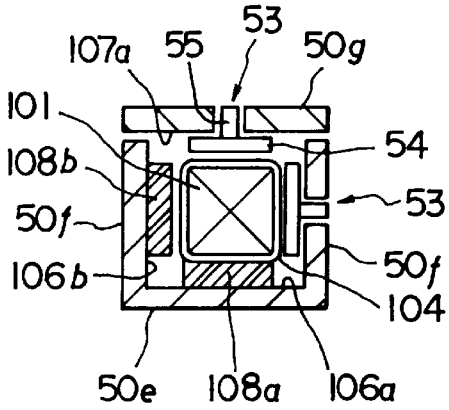
FIG. 12B is across sectional view taken on line XIIB—XIIB of FIG. 12A according to the third embodiment.

Moreover, FIG. 12A and FIG. 12B show a construction of a fuel protective container 50B according to another modification of the third embodiment.

As shown in FIG. 12A and FIG. 12B, the fuel assembly 101 is inserted and provided with a transport separator 110 which has a dimension same as the external dimension of the fuel spacer 104 or slightly larger than that. The fuel assembly 101 is housed in the fuel protective container 50B in which the protective members 108*a* to 108*d* attached to the inner peripheral side surfaces 106*a* to 106*d* and 107*a* is flat.

In the housed fuel assembly 101, both fuel spacer 104 and transport separator 110 contact with the protective members 108*a* to 108*d*. Further, a fastening mechanism 53 comprising a fastening plate 54 and a drive mechanism 55 is provided on the cap member 107A of the fuel protective container 50B and the fuel spacer 104 on one of the inner peripheral side surfaces 106*b* of the container main body 106. Whereby the fuel assembly 101 is fixedly supported together with the fuel protective container 50B via the fuel spacer 104.

As described above, the fuel assembly 101 is inserted and provided with a transport separator 110 which has a dimension same as the external dimension of the fuel spacer 104 or slightly larger than that, and then, the fuel assembly 101 is housed in the fuel protective container 50B. Further, on the cap member 107A of the fuel protective container 50B and one inner peripheral side surface 106*b* of the container main body 106, the fuel assembly 101 is fixedly supported on the fuel spacer 104 by means of the fastening mechanism 53 together with the fuel protective container 50B. Therefore, according to the another modification, the fuel rods situated on the lowermost row can be prevented from being plastically deformed by a force of instantaneously great acceleration. Further, a tightly fixing force can be surely secured in the horizontal direction and in the vertical direction with respect to a vibration during transport; therefore, the fuel assembly 101 can be more safely transported.

In addition, the construction of the fuel protective container 50B shown in FIG. 12A and FIG. 12B is applicable to the above first and second embodiments.

Moreover, in this embodiment, the protective container 50 has the structure shown in FIGS. 10~12A, 12B . The present invention is not limited to this structure but may apply to the structure shown in FIGS. 25A , 25B.

Figure 13A:
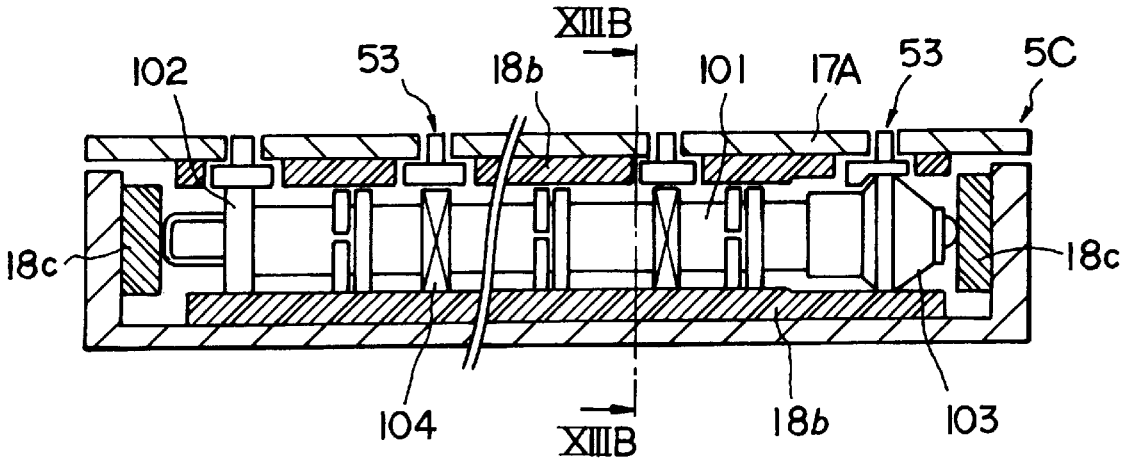
FIG. 13A is a cross sectional view s taken on line XIIIA—XIIIA of FIG. 13B showing a construction of a fuel protective container according to a further modification of the third embodiment.
Figure 13B:
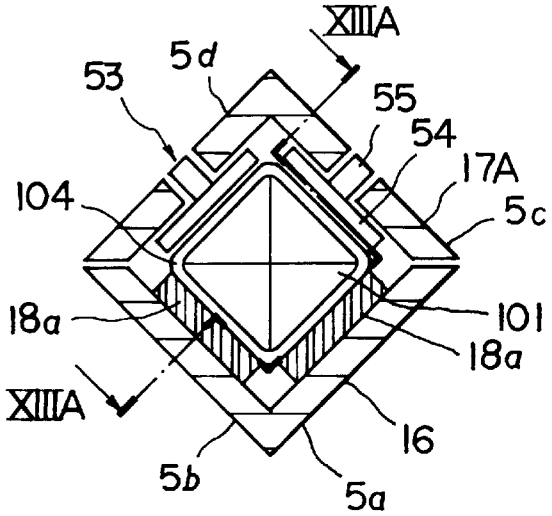
FIG. 13B is a cross sectional view taken on line XIIIB—XIIIB of FIG. 13A.

Specifically, as seen from FIG. 13A and FIG. 13B, when the transport container (not shown) housing the fuel protective containers 5C is horizontally positioned, The lower-side outer side surfaces 5*a*, 5*b* are inclined at the angle of substantially 45° to the horizontal plane, like the above first and second embodiments.

The fastening mechanism 53 comprising the fastening plate 54 and the drive mechanism 55 is provided on the outer side surfaces 5*c*, 5*d* of the cap member 17A of the fuel protective container 5C so that the fuel assembly 101 is fixedly supported together with the fuel protective container 5C via the fuel spacer 104.

Therefore, in addition to the same operation and effect of the modification shown in FIGS. 12A and 12B.

The same operation and effect of the above first and second embodiments is obtained whereby a greater tightly fixing force is secured by a small fastening force, so that the fuel assembly 101 can be more safely transported.

Figure 14A:
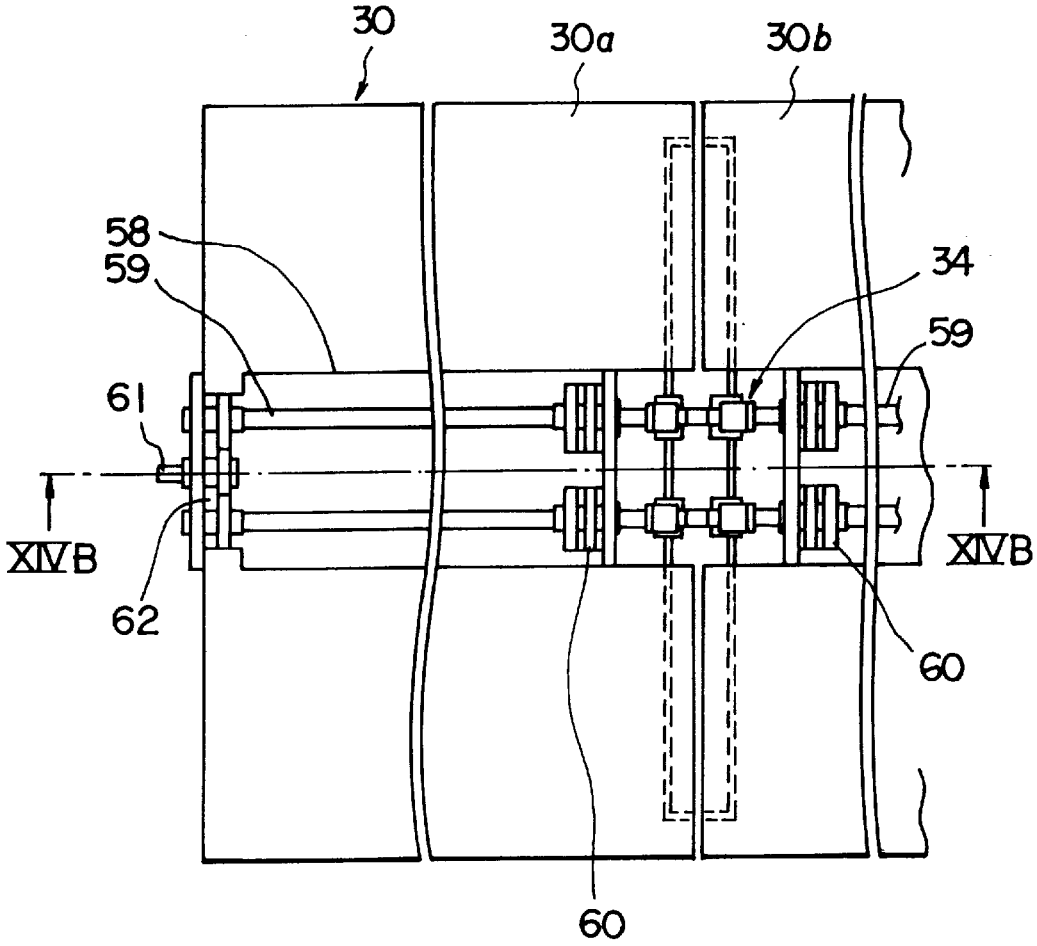
FIG. 14A is a plan view showing principal parts of the drive device according to a fourth embodiment of the present invention.
Figure 14B:
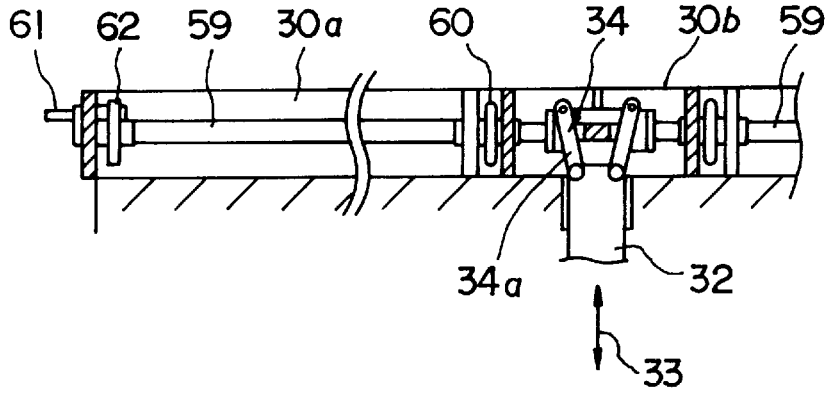
FIG. 14B is a cross sectional view showing principal parts of the drive device taken on line XIVB—XIVB of FIG. 14A.

A fourth embodiment relates to a drive device of the fixedly supporting device according to the above second embodiment. FIG. 14A is a plan view showing principal parts of the paired drive mechanisms, and FIG. 14B is a cross sectional view showing principal parts of the paired drive mechanisms cut along a line XIVB—XIVB of FIG. 14A. In order to move the grid plate 32 of the fixedly supporting device to the diagonal direction, a drive device 58 is provided on an upper side portion of the basket 30 of the fuel transport container which is situated to a lateral position. Further, in order to stably move the square-shaped grid plate 32 to the diagonal direction, the paired two drive mechanisms 34 are attached onto the upper side portion of the grid plate so as to be structurally symmetrical. The symmetrical portions are symmetrical with respect to the cross section which crosses a center of a width of the grid plate 32 along a surface thereof.

The fixedly supporting device is interposed between divisional baskets 30*a* to 30*c* mutually joined, and in the fixedly supporting device, the two drive mechanisms 34 and rotating shafts 59 are connected by means of a coupling 60, respectivelly. The distal end portion of the divisional basket top portion 30*a* is provided with a cooperative mechanism 62 for simultaneously driving the two rotating shafts 59 by means of one fastening force adjusting shaft 61.

Each of the aforesaid drive mechanisms 34 comprises arms 34*a* which are structurally symmetrically attached with respect to an axial direction of the adjusting shaft 61 on the upper side portion of the grid plate 32, a screw shaft, a link and the like. The drive mechanisms 34 are adapted to be driven by rotation of the rotating shafts 59 via the arms 34*a* so as to move the grid plate 32 to the diagonal direction.

Further, the aforesaid fastening force adjusting shaft 61 simultaneously drives the two rotating shaft 59 by the same rotation as the rotating shafts thereof via the cooperative mechanism 62 in the distal end portion of the divisional basket top portion 30*a*.

In the aforesaid manner, respective grid plates 32 are simultaneously moved to the identical direction and by only fixed displacement via each two-system drive mechanisms 34, and thus, a fastening force by the grid plate 32 which is a tightly fixing force with respect to all fuel protective containers 5 can be adjusted.

Next, the following are an explanation about an operation and effect obtained from the above construction and a fuel transport method. In a mount process for housing the fuel protective container in the fuel transport container, all fuel protective containers 5 is housed in the fuel transport container which is in the vertical state. Thereafter, in order to move the grid plate 32 to the diagonal direction at two portions symmetrical in right and left, the drive device 58 of the fixedly supporting device simultaneously drives each two-system drive mechanism 34 by means of one fastening force adjusting shaft 61 provided on the upper portion of the basket 30 via the cooperative mechanism 62.

Whereby respective grid plates 32 mutually interposed between divisional baskets 30*a* to 30*c* are simultaneously moved to the identical direction and by only fixed displacement. As a result, all fuel protective containers 5 can be fixedly supported on the respective basket holes 4 at the same time.

The displacement of all grid plates 32 is adjusted by means of the aforesaid one fastening force adjusting shaft 61, and thereby, it is possible to make an adjustment of a tightly fixing force for fixedly supporting the fuel protective container 5.

Thus, a fixedly supporting work is easy with respect to the fuel protective container housed in the transport container in the mount process; therefore, a work efficiency can be improved, and also, a reduction of work can be achieved.

In the transport process, in the case where an exothermic fuel assembly 101 is housed in the basket 30, a temperature of the basket 30 rises during transport, and then, the temperature of a portion which is near to the central axis of the basket 30 becomes higher. However, the drive device 58 including the drive mechanism 34 which is the fixedly supporting device is provided on the outer peripheral vicinity of the basket 30 where the rise of temperature does not so occur; for this reason, there is almost no influence of the rise of temperature of the basket 30. Therefore, a high reliability of the fixedly supporting device can be maintained.

In the above fourth embodiment, since the drive mechanism 58 including the drive mechanism 34 which is the fixedly supporting device is a small size, the aforesaid first problem can be solved. Further, since the drive device 58 of the fixedly supporting device is provided on the outer peripheral vicinity of the basket 30, the drive device 58 has no influence of the rise of temperature of the basket 30 during the transport operation. Thus, the high reliability of the drive device 58 can be maintained.

Moreover, the drive device 58 of the fixedly supporting device moves all grid plates 32 by operating the fastening force adjusting shaft 61 provided on the distal end portion of the divisional basket top portion 30*a*, and then, fixedly supports all fuel protective containers 5 at the same time. Therefore, the fixedly supporting work can be reduced.

A fifth embodiment of the present invention relates to a fixedly supporting device which is the substantially same as that of the above second embodiment. For this reason, a detailed explanation of components, operation and effect and a fuel transport method common to the second embodiment is omitted.

Figure 15A:
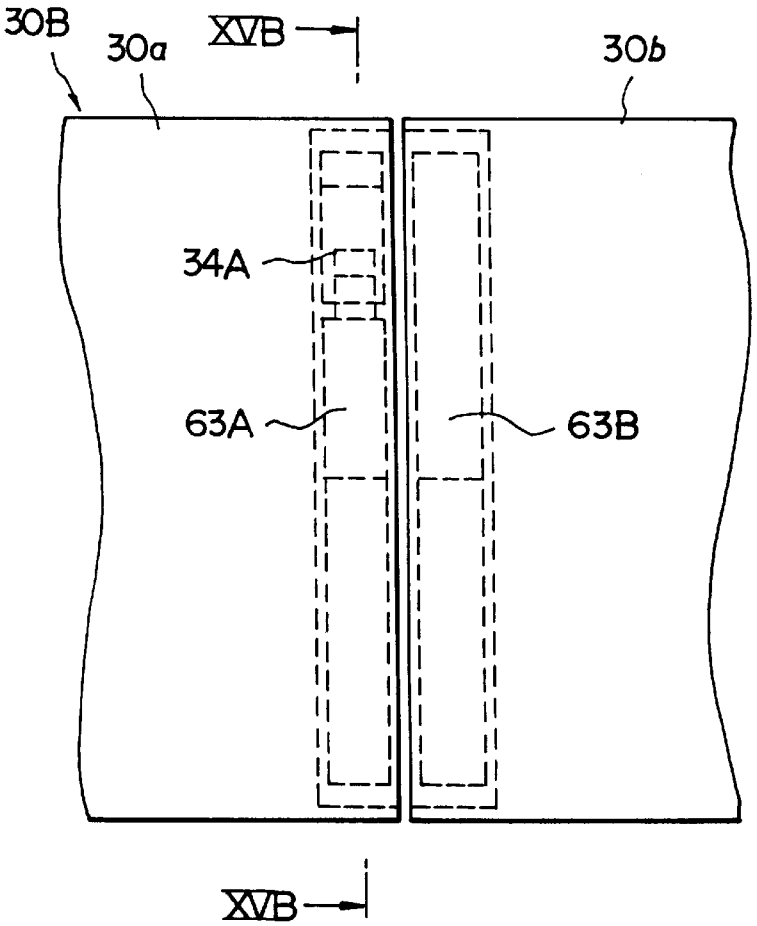
FIG. 15A is a side view showing principal parts of a basket according to a fifth embodiment of the present invention.

As shown in FIG. 15A which is a side view showing principal parts of the basket, the basket 30B of the fuel transport container has a square cross section and a plurality of basket holes 4 extending long. When the fuel transport container is horizontally positioned, the lower side inner peripheral surfaces 4*a*, 4*b* of each of the basket holes 4 are inclined at a predetermined angle of, for example, substantially 45° with respect to the bottom surface 2*a* of the fuel transport container corresponding to the horizontal plane.

The basket 30B is divided into plural portions in the longitudinal direction thereof. Here, a divisional basket top portion 30*a* which is the top portion when the transport container is in the vertical state, and a divisional basket 30*b* following the top portion 30*a*, are shown.

Figure 15B:
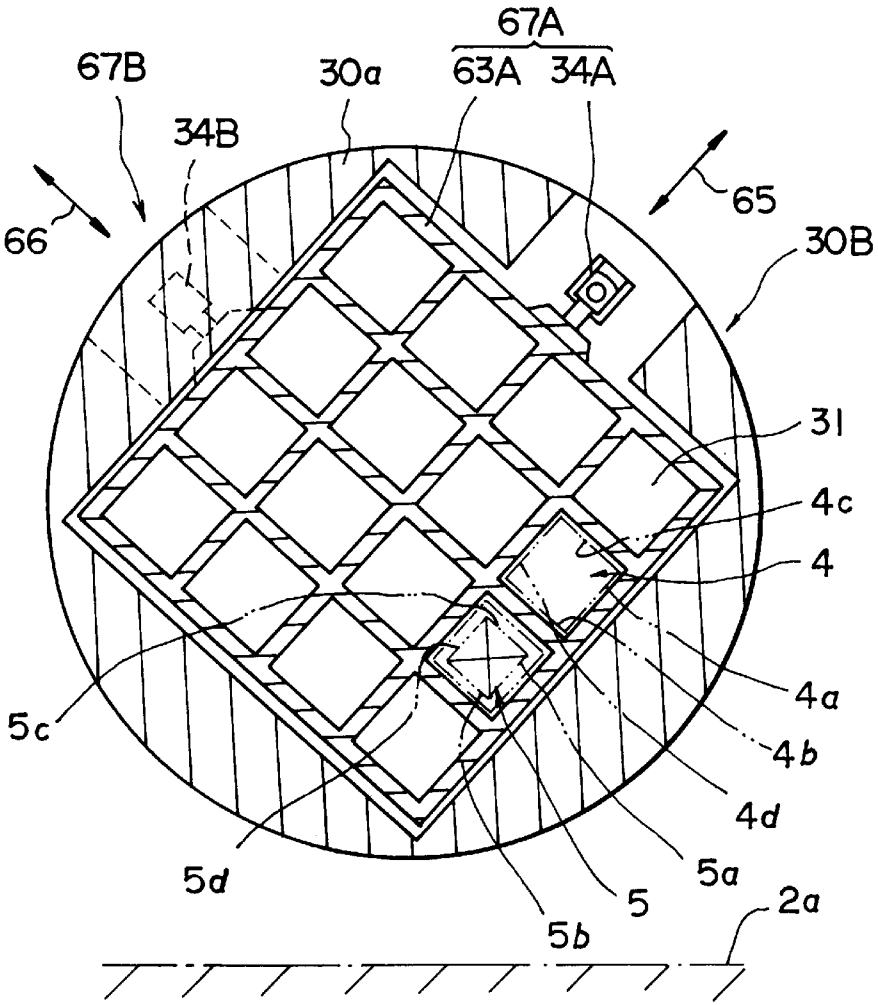
FIG. 15B is a cross sectional view taken on line XVB—XVB of FIG. 15A.

As shown in FIG. 15B which is a cross sectional view cut along a line XVB—XVB of FIG. 15A, two grid plates 63A and 63B, which have a square shape and are each formed with holes holes 31 having the same arrangement as the basket holes 4, respectively, are arranged so as to face each other at the portion mutually joining divisional baskets 30*a* and 30*b*.

In order to move these square shaped grid plates 63A and 63B, to directions (shown by arrows 65 and 66) which are parallel to and perpendicular to one side of the square cross-section grid hole 31 corresponding to one inner peripheral side surface 4*b* of the basket hole 4, respectively, drive mechanisms 34A and 34B are provided obliquely upper side portions of respective grid plates 63A and 63B so that fixedly supporting devices 67A and 67B are constructed on the outer peripheral vicinity of the basket 30, respectively.

Further, the portion mutually joining the aforesaid divisional baskets 30*a* and 30*b* is provided with the joint means shown in the above second embodiment so that these divisional baskets are joined together, whereby a fuel transport container comprising the basket 30B which is provided with the aforesaid fixedly supporting devices 67A and 67B.

Next, the following is an explanation about an operation and effect obtained from the above construction and a fuel transport method. First, the divisional basket 30*b* and the divisional basket top portion 30*a* are vertically assembled in the named order so as to construct the basket 30 of the fuel transport container.

At this time, the grid plates 63A and 63B including the drive mechanisms 34A and 34B each of which functions as the fixedly supporting device, respectively are interposed between the portion mutually joining these divisional baskets 30*a* and 30*b*.

When the fuel transport container is horizontally positioned during transport, one of the inner peripheral side surfaces 4*a*, 4*b* of the basket hole 4 is inclined at the angle of substantially 45° to the horizontal plane 2*a* and respective drive mechanisms 34A and 34B are arranged on the obliquely upper portion of the grid plates 63A and 63B, respectively, so as to be symmetrically positioned each other.

Subsequently, in the mount process, the fuel protective container 5 housing the fuel assembly 101 such as the MOX fuel assembly is hoisted and put down so as to be housed in the basket hole 4 of the basket 30B of the fuel transport container which is in the vertical state.

At the point of time all of fuel protective containers 5 are completely housed in the basket 30B, each of the drive mechanism 34A and 34B of the fixedly supporting device 67A and 67B is operated so as to move the grid plate 63A and the grid plate 63B by a fixed displacement.

That is, the drive mechanism 34A makes the grid plate 65A move toward the inner peripheral side surface 4*b* along the inner peripheral side surface 4*a* corresponding to the arrow 65 and the drive mechanism 34B makes the grid plate 65B move toward the inner peripheral side surface 4*a* along the inner peripheral side surface 4*b* corresponding to the arrow 66, the moving direction of the grid plate 65B being perpendicular t the moving direction of the perpendicular to the moving direction of the grid plate 65A.

Whereby the fuel protective containers 5 housed in the basket holes 4 are all fixedly supported on the groove portion formed by the inner peripheral side surfaces 4*a*, 4*b* of the basket hole 4 by means of the two grid plates 63A and 63B, respectively.

As seen from the above description, in the fifth embodiment, completely independent two-system grid plates 63A and 63B and the drive mechanism 34A and 34B for moving each grid plates are required for constructing the fixedly supporting devices 67A and 67B. However, these grid plates 63A and 63B and each drive mechanisms have a simple structure, so that these grid plates can be stably moved. Further, according to the fifth embodiment, the effect for solving the above problems can be obtained inclusive of the transport process, like the above second embodiment.

A sixth embodiment of the present invention relates to a fixedly supporting device which is the substantially same as that of the above second and fifth embodiments. For this reason, a detailed explanation of components, operation or effect and a fuel transport method common to the second and fifth embodiments is omitted.

Figure 16A:
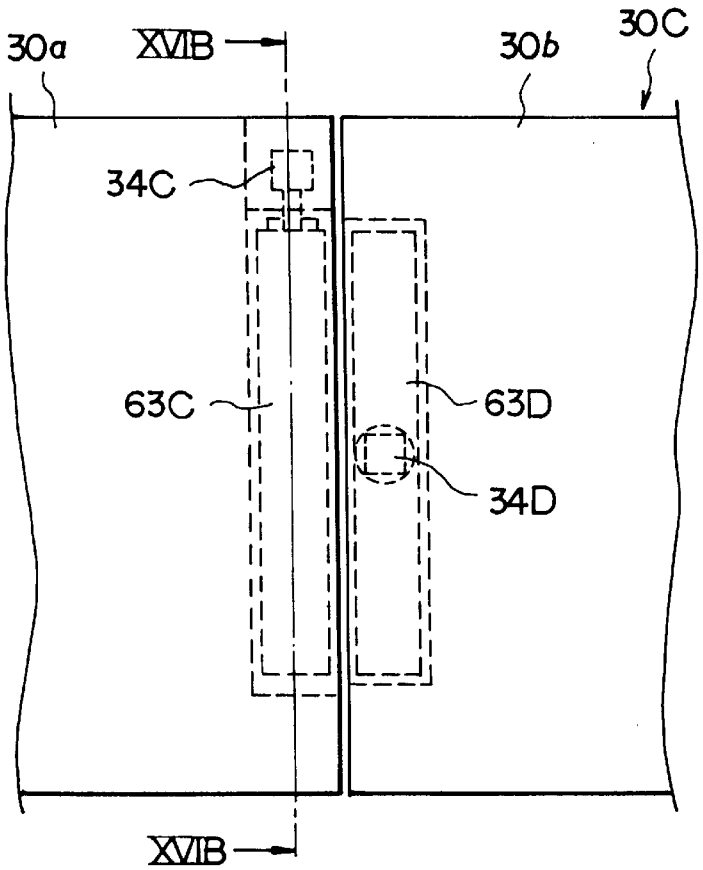
FIG. 16A is a side view showing principal parts of the basket according to a sixth embodiment of the present invention.

As shown in FIG. 16A which is a side view showing principal parts of the basket, the basket 30C of a fuel transport container has a square cross section and a plurality of basket holes 4A extending long. Each of the basket holes 4A has the inner bottom surface 4*e*, the inner peripheral side surfaces 4*f* and the inner top surface 4*g*, the inner bottom surface 4*e* being positioned along the bottom surface 2*a* of the fuel transport container corresponding to the horizontal direction.

The fuel protective container 50 is housed in the basket hole 4A so that the outer bottom surface 50*e*, the outer side surfaces 50*f* and the outer top surface 50*g* are opposite to the inner bottom surface 4*e*, the inner side surface 4*f* and the inner top surface 4*g*, respectively.

The basket 30C is divided into plural portions in the longitudinal direction thereof. Here, a divisional basket top portion 30*a* which is the top portion when the transport container is in the vertical state, and a divisional basket 30*b* following the top portion 30*a*, are shown.

Figure 16B:
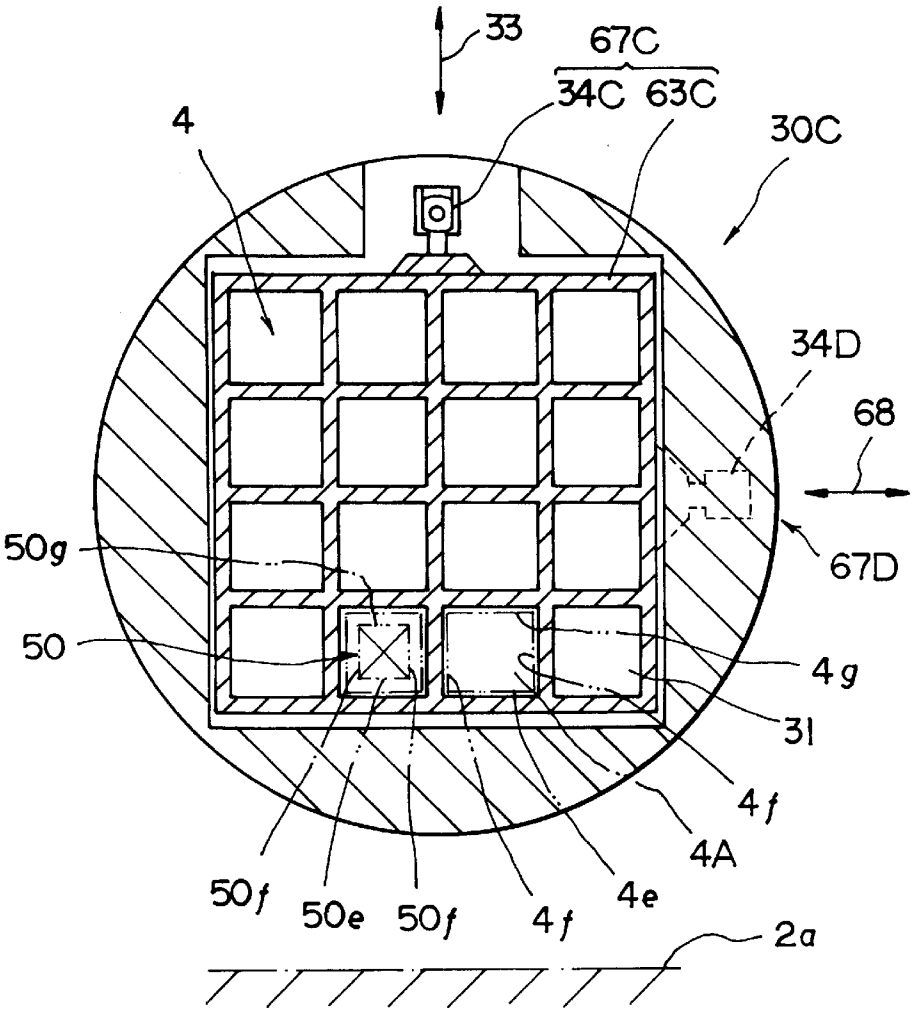
FIG. 16B is across sectional view taken on line XVIB—XVIB of FIG. 16A.

As shown in FIG. 16B which is a cross sectional view cut along a line XVIB—XVIB of FIG. 16A, two grid plates 63C and 63D, which have a square shape and are each formed with grid holes 31 having the same arrangement as the basket holes 4A, respectively, are arranged so as to face each other at the portion mutually joining divisional baskets 30*a* and 30*b*.

In order to move these square shaped grid plates 63C and 63D to directions (shown by an arrow 33 and 68) which are parallel to and perpendicular to one side of the grid hole 31 corresponding to the inner side surface 4*f* of the basket hole 4A, respectively, drive mechanisms 34C and 34D are provided on outer sides of respective grid plates 63C and 63D so that fixedly supporting device 67C and 67D are constructed on the outer peripheral vicinity of the basket 30C, respectively.

Further, the portion mutually joining the aforesaid divisional baskets 30*a* and 30*b* is provided with the joint means shown in the above second embodiment so that these divisional baskets are joined together so that a fuel transport container comprising the basket 30C which is provided with the aforesaid fixedly supporting device 67C and 67D.

Next, the following is an explanation about an operation and effect obtained from the above construction and a fuel transport method. First, the divisional basket 30*b* and the divisional basket top portion 30*a* are vertically assembled in the named order so as to construct the basket 30 of the fuel transport container. At this time, the grid plates 63C and 63D including the drive mechanisms 34C and 34*d* which function as the fixedly supporting device are interposed between the portion mutually joining these divisional baskets 30*a* and 30*b*.

In the mount process, the fuel protective container 50 housing the fuel assembly 101 such as the MOX fuel assembly is hoisted and put down so as to be housed in the basket hole 4A of the basket 30C of the fuel transport container which is in the vertical state.

After all of fuel protective containers 50 are completely housed in the basket 30C, each of the drive mechanisms 34C and 34D of the fixedly supporting devices 67C and 67D is operated so as to move the grid plate 63C and the grid plate 64D to the directions shown by the arrow 33 and 68 by a fixed displacement. Namely, the drive mechanism 34C makes the grid plate 65C move toward the inner bottom surface 4*e* along the direction of the arrow 33 and the drive mechanism 34D makes the grid plate 65D move toward one of the inner side surfaces 4*f* which is far from the supporting device 67D as compared with the other of the inner side surfaces 4*f* along the horizontal direction shown by the arrow 68, the moving direction of the grid plate 65D being perpendicular to the moving direction of the grid plate 65C.

As a result of that, the fuel protective containers 50 housed in the basket holes 4A, are all fixedly supported on a V shaped left corner portion formed by the inner bottom surface 4*e* and the one of the inner side surfaces 4*f* of the basket hole 4 by means of two grid plates 63C and 63D.

When the fuel transport is horizontally positioned, in the basket hole 4A, a portion supporting the own weight of the fuel protective container 50 is flat, and is not inclined as the above second embodiment. For this reason, in order to obtain the same fixedly supporting effect as the second embodiment, great forces by the drive mechanism 34C and 34D are required as a greater fixedly supporting force.

However, each of the fixedly supporting devices 67C and 67D is small and compact size, and there can be provided a fuel transport container which has a large capacity capable of housing a plurality of fuel protective containers 50. Therefore, a fixedly supporting work is greatly reduced together with the fuel transport method, and the effect capable of solving the aforesaid problem is the same as the above second embodiment.

Figure 17:
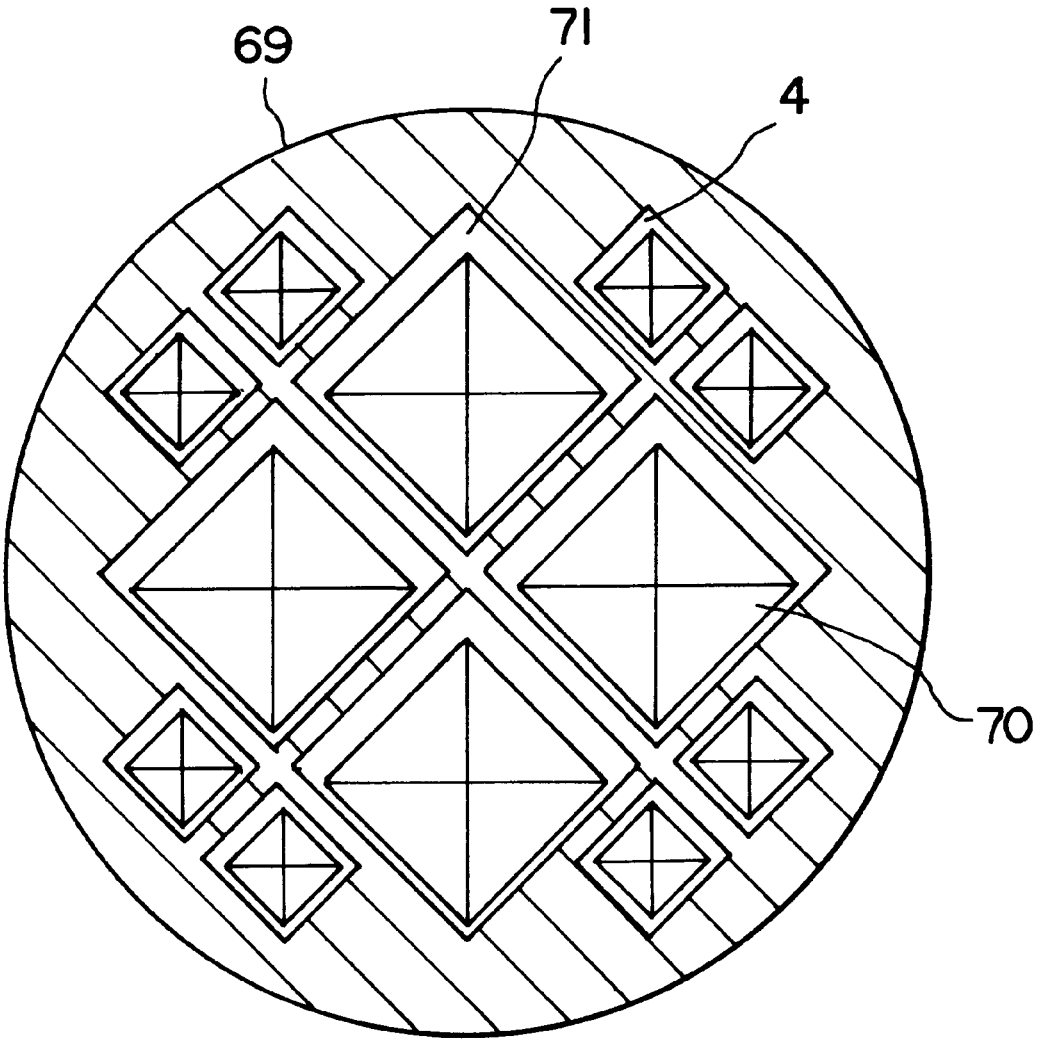
FIG. 17 is a comparative cross-sectional view of a basket of a fuel transport container according to a seventh embodiment of the present invention.

A seventh embodiment relates to a fuel transport container which has a large capacity. As shown in FIG. 17 which is a comparative cross-sectional view of a basket of a fuel transport container. The basket 69 of the fuel transport container is formed with four large-size basket holes 71 which individually have a square cross section at the central portion thereof. A large-size fuel protective container 70 collectively housing at least four fuel assemblies 101 such as the MOX fuel assemblies is housed in each of the large-size basket holes 71.

Further, the basket 69 is formed with a pair of two basket holes 4 for housing a fuel protective container 5 housing one fuel assembly 101. The pair of two basket holes 4 are formed on four portions around the circumference of the aforesaid four large-size basket holes 71.

Next, the following is an explanation about an operation and effect obtained from the above construction and a fuel transport method. As seen from FIG. 18A which is a cross sectional view showing principal parts of the basket 69, the basket 69 is formed with a large-size basket hole 71 which houses the large-size protective container 70 collectively housing four fuel assemblies 101.

This large-size fuel protective container 70 is capable of housing four fuel assemblies 101. Therefore, the cross section of the large-size fuel protective container 70 has a square shape which is excellent in arrangement performance. Further, since one side of the square cross section (each chamber) of the basket hole 71 is an outer peripheral portion facing one side of the large-size protective container 70, an open and close door for taking in and out the fuel assembly is provided therein.

As described above, the large-size fuel protective container 70 collectively houses four fuel assemblies 101. Therefore, the cross section of the basket hole 71 of the basket 69 can be made smaller than the cross section of an arrangement in which four square-shaped basket holes 4 are formed in the basket 3 shown in FIG. 18B.

Figures 18A, 18B:
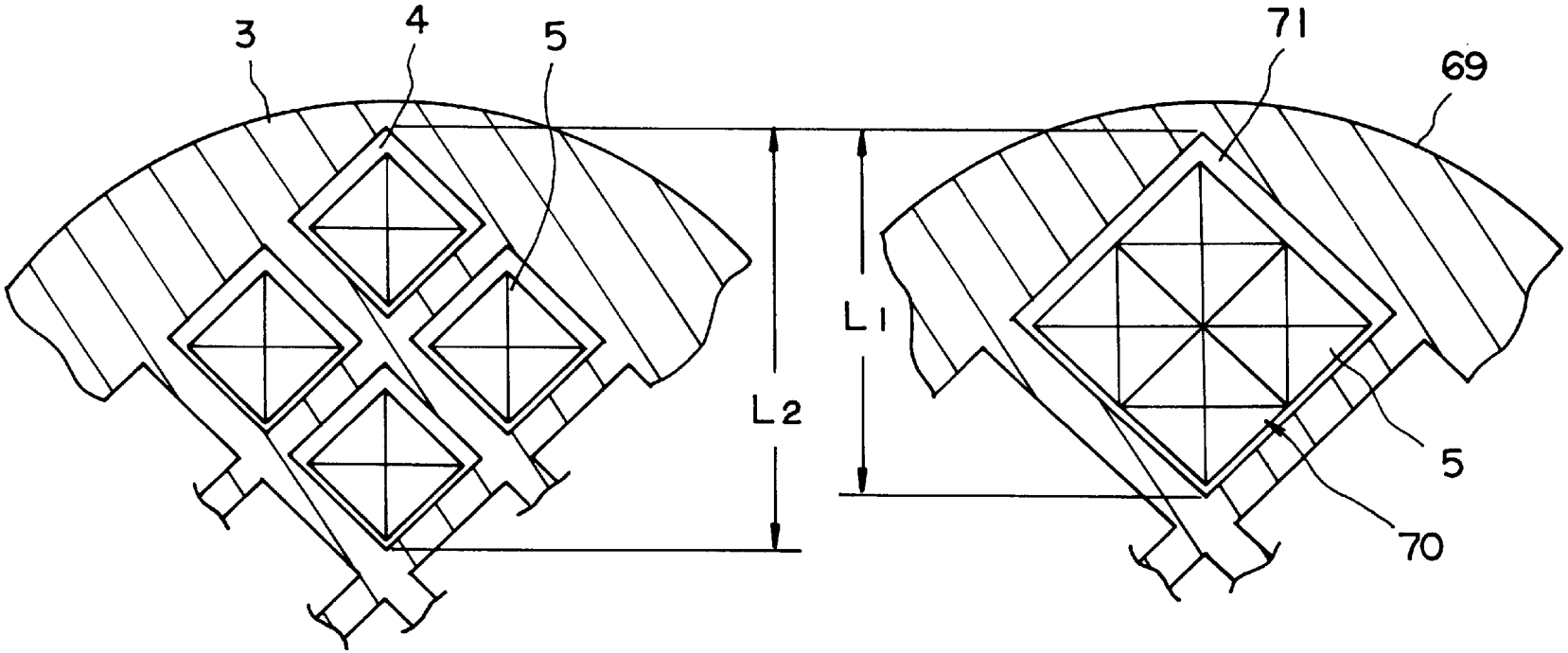
FIG. 18A is an enlarged cross sectional view showing principal parts of the basket shown in FIG. 17.
FIG. 18B is an enlarged cross sectional view showing principal parts of a four square-shaped basket.

As is evident from the comparison between the diagonal length L1 of the large-size basket hole 71 and the case of the basket 3 shown in FIG. 18B, that is, the diagonal length L2 of respective four basket holes 4 which house the fuel protective container 5 housing one fuel assembly 101, the large-size basket hole 71 is smaller, so that the basket 69 can be made into a small size.

The basket 69 is made into a small size, and thereby, it is possible to provide a compact fuel transport container. Further, as seen from FIG. 17, the number of housing fuel assemblies is increased by making a combination of the large-size basket hole 71 and the basket hole 4. Therefore, the fuel transport container which has a large capacity can be readily provided.

In a mount process of the seventh embodiment, the fuel protective container 5 and the large-size fuel protective container 70 are housed in the basket 69, and then, are easily fixedly supported with the use of the aforesaid various fixedly supporting devices. The transport process is also carried out like the case of the above second embodiment.

An eighth embodiment relates to positioning of a fuel protective container in a basket, and shows an example of employing a fixedly supporting manner of, for example, the above second embodiment. In this case, the fixedly supporting manner and a direction in a basket hole are not specially limited to the accompanying drawings.

For example, the fixedly supporting device which is shown in the above first embodiment may be applied to the eighth embodiment.

Figure 19A:
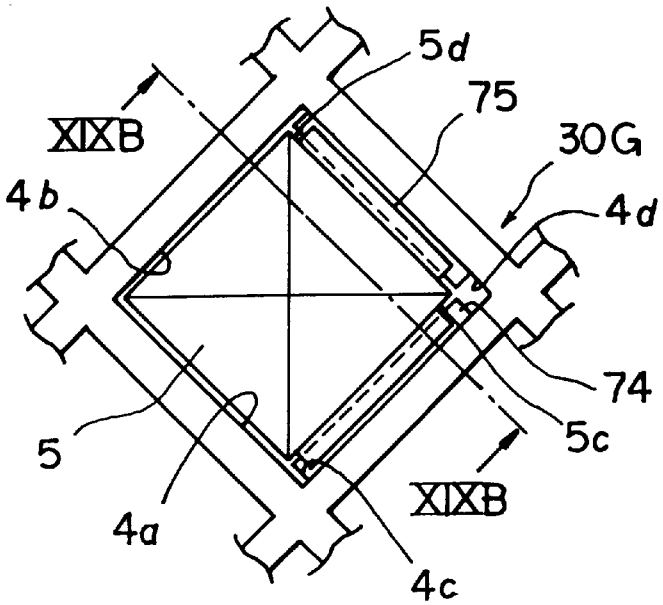
FIG. 19A is a plan view showing principal parts of a basket according to an eighth embodiment of the present invention.
Figure 19B:
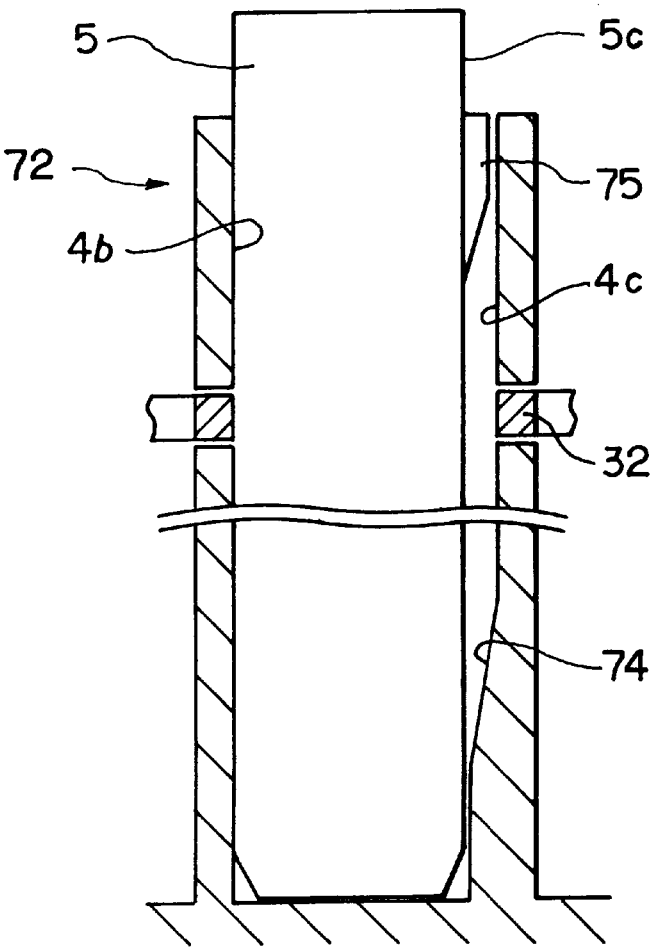
FIG. 19B is a cross-sectional view cut along a line XIXB—XIXB of FIG. 19A.

As shown in FIG. 19A which is a plan view showing principal parts of a basket and in FIG. 19B which is a cross-sectional view cut along a line XIXB—XIXB of FIG. 19A, the basket 30G of a fuel transport container is formed with a basket hole which has a square cross section. Further, in the basket 30G, the upper-side inner peripheral side surfaces 4*c*, 4*d* which are adjacent each other are provided with tapered projecting portions 74 projecting to the lower side inner peripheral side surfaces 4*a*, 4*b* at the bottom portion thereof, respectively. A grid plate 32 of a fixedly supporting device (not shown) is provided therein.

The fuel protective container 5 housed in the basket hole 4 is provided with tapered portions 75 at adjacent two outer side surfaces 5*c*, 5*d* which are opposite to the inner peripheral side surfaces 4*c*, 4*d*, respectively. The tapered portions 75 projecting to the inner peripheral side surfaces 4*c*, 4*d* are positioned adjacent to an opening end of the of the basket hole 4 when the fuel protective container 5 is housed in the basket hole 5.

Next, the following is an explanation about an operation and effect obtained from the above construction and a fuel transport method. In a mount process, the fuel protective container 5 is hoisted and put down so as to be housed in the basket hole 4 of the basket 72 of the fuel transport container which is in the vertical state.

At this time, the fuel protective container 5 is positioned so that the tapered portions 75 projecting from adjacent two outer side surfaces 5*c*, 5*d* of the fuel protective container 5 correspond to the tapered portions 34 formed on adjacent inner peripheral side surfaces 4*c*, 4*d* of the basket hole 4 of the basket 72.

In order to easily insert the long and heavy fuel protective container 5 into the basket hole 5 extending long, an inner dimension (diameter) of the basket hole 4 is set to a value properly larger than an outer dimension of the fuel protective container 5. An operation for inserting and positioning the fuel protective container 5 in the basket hole 4 should be very carefully carried out.

However, in the opening of the basket hole 4 having the tapered portions 74 projecting from the bottom portion thereof, there is a sufficient gap with respect to the fuel protective container 5 hoisted and put down in the aforesaid manner. Therefore, it is possible to easily insert the fuel protective container 5 into the basket hole 4.

Subsequently, the fuel protective container 5 is put down up to the bottom portion of the basket hole 4. At this time, the lower portion of the fuel protective container 5 is guided along the tapered portion formed on the inner side surfaces 4*c*, 4*d*; on the other hand, the upper portion thereof is guided along the tapered portion 75 projecting from the outer side surfaces 5*c*, 5*d*. In this manner, the fuel protective container 5 is positioned in a state of being biased and abutted against the inner peripheral side surfaces 4*a*, 4*b* opposite to the inner peripheral side surfaces 4*c*, 4*d* formed with the tapered portions 74.

Thereafter, in order to fixedly supporting the fuel protective container 5, the grid plate 32 of the fixedly supporting device is moved. In this case, positioning of the fuel protective container 5 in the basket hole 4 has been already performed, so that the fixedly supporting operation can be easily performed.

Further, in a transport process, the fuel protective container 5 can be transported in a state of fixedly supported by means of the aforesaid tapered portions 74 and 75 together with the grid plate 72 of the fixedly supporting device.

Figure 20:
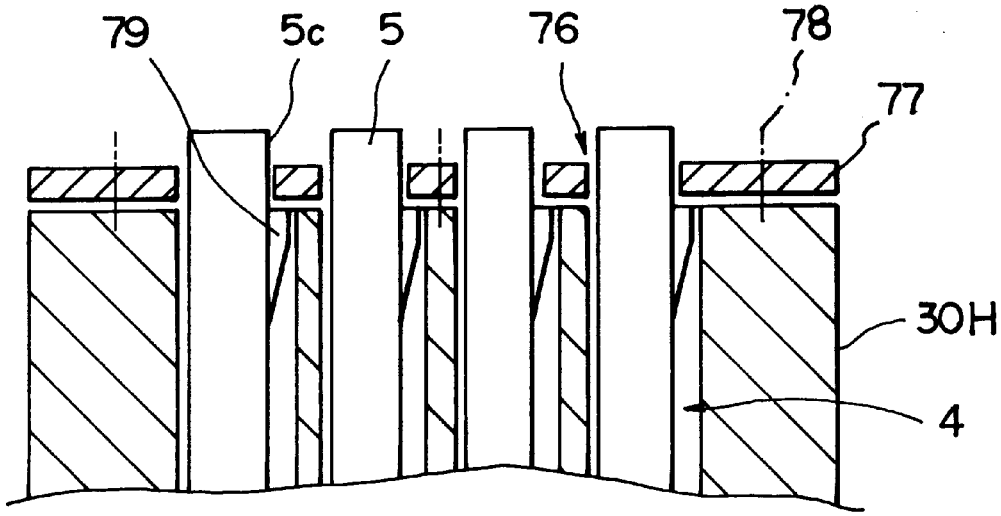
FIG. 20 is a cross-sectional view showing principal parts of a basket according to a ninth embodiment of the present invention.
Figure 21B:
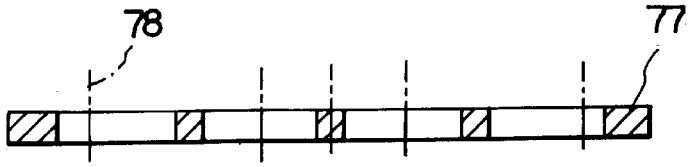
FIG. 21B is a cross-sectional view cut along a line XXIB—XXIB of FIG. 21A.
Figure 21A:
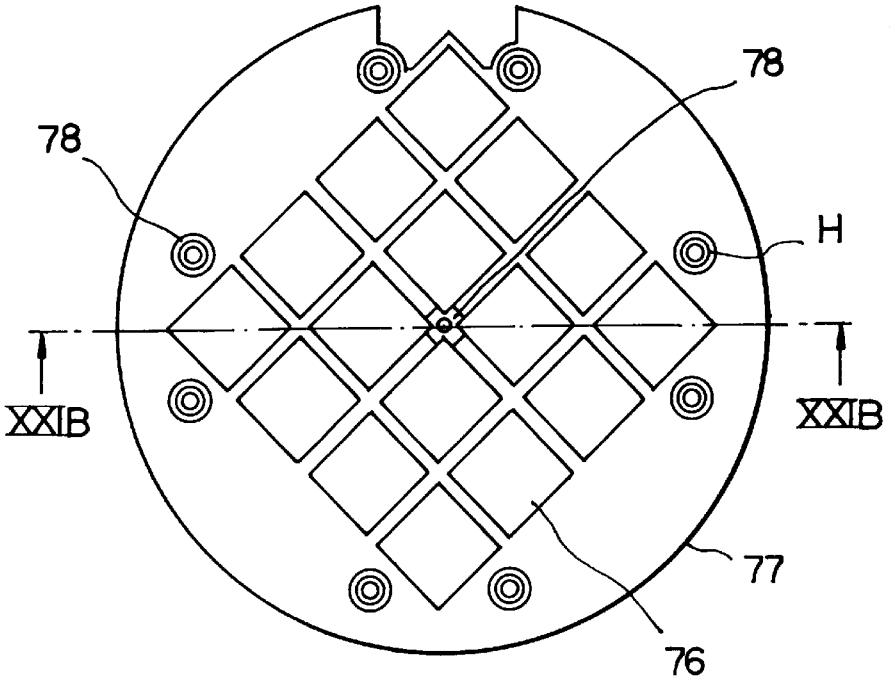
FIG. 21A is an enlarged plan view showing a flat fixing plate of FIG. 20.

A ninth embodiment relates to a fixedly supporting device of a fuel protective container. As shown in FIG. 20 which is a cross-sectional view showing principal parts of a basket, a flat fixing plate 77 is pressed against an opening end of the basket 30H of a fuel transport container and then, is fixed thereto with the use of a fixing bolt 78. As shown in FIG. 21A which is a plan view and FIG. 21B which is a cross-sectional view cut along a line XXIB—XXIB of FIG. 21A, the flat fixing plate 77 is formed with holes 76 which has the same arrangement as the basket holes 4.

Further, the fuel protective container 5 housing the fuel assembly 101 such as the MOX fuel assembly is provided with a projected portion 79 at the outer side surfaces 5*c*, 5*d* thereof. The projected portion 79 is provided on a position of being pressed against the aforesaid fixing plate 77 attached to the opening end of the basket 72 so as to be detachable therefrom when the fuel protective container 5 is housed in the basket 30H.

Next, the following is an explanation about an operation and effect obtained from the above construction and a fuel transport method. In a mount process, the fuel protective container 5 is hoisted and put down so as to housed in the basket hole 4 when the basket 30H of the fuel transport container is in the vertical state.

The fuel protective containers 5 are all housed in the basket hole 4, and thereafter, the fuel protective container 5 passes through the hole 76 of the fixing plate 77. And then, the fixing plate 77 is pressed against the opening end of the basket 72 together with the projecting portion 79 formed on the outer side surfaces 5*c*, 5*d* of the fuel protective container 5. Thereafter, the fixing plate 77 is fixed thereto with the use of the fixing bolt 78.

As a result of that, the fuel protective containers 5 housed in the basket holes 4 are all fixedly supported by means of the fixing plate 77. As a result, the motion of the fuel protective container 5 is restricted in the axial direction and the lateral direction. In general, in the transport process, the fuel transport container is transported in a state of being horizontally positioned; for this reason, in particular, the fuel protective container 4 must be fixedly supported in the axial direction thereof.

According to the above ninth embodiment, a plurality of fuel protective containers 5 are fixedly supported in the axial direction at the same time by fixing one fixing plate 77 with the use of the fixing bolt 78. Therefore, this manner of the ninth embodiment considerably can reduce the fixedly supporting work as compared with the manner of fixedly supporting fuel protective containers 5 individually.

A tenth embodiment relates to a member for preventing a fixing bolt from coming down or coming off from the fixing plate 77 of the above ninth embodiment and an eleventh embodiment.

Figure 21C:
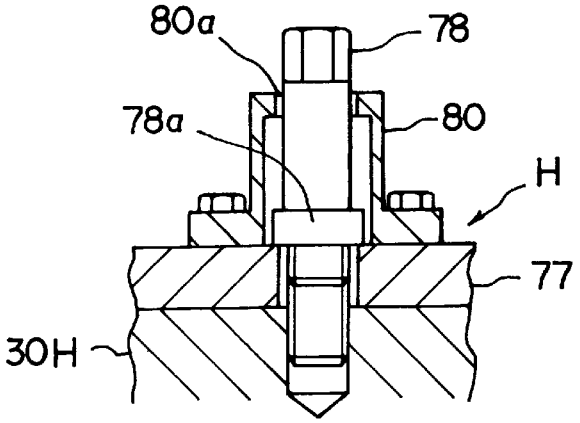
FIG. 21C is an enlarged cross-sectional view of an H portion of FIG. 21A according to a tenth embodiment of the present invention.

As shown in FIG. 21C which is an enlarged cross-sectional view of an H portion of FIG. 21A, a bolt come-down preventive member 80 has a substantially cylindrical cap-shape, and is provided with a hole 80*a* at the upper portion thereof. The hole 80*a* is formed so as to pass a head portion of the fixing bolt 78 having a diameter smaller than a large diameter portion 78*a* formed on an intermediate portion of the fixing bolt 78.

Next, the following is an explanation about an operation and effect obtained from the above construction. When fixing the aforesaid fixing plate 77 to the opening end of the basket 30H, the fixing bolt 78 is previously passed through a bolt hole 77*a* formed in the fixing plate 77. And then, the lower portion of the large diameter portion 38*a* is abutted against the fixing plate 77, and thus, the fixing bolt 78 is attached to the fixing plate 77 in the manner of passing the head portion of the fixing bolt 78 through the hole 80*a* of the bolt come-down preventive member 80.

This structure results in that the fixing bolt 78 is prevented from coming off because the large diameter portion 78*a* thereof is held in the hole 80*a* of the bolt come-down preventive member 80 together with the bolt hole 77*a* of the fixing plate 77.

In a mount process, when fixedly supporting the fuel protective container 5 housed in the basket 30H, the fixing plate 77 is pressed against the projecting portion 79 formed on the fuel protective container 5, and then, is fixed to the opening end of the basket 30H with the use of the fixing bolt 78.

At this time, since the bolt come-down preventive member 80 is mounted, no accident occurs such that the fixing bolt 78 comes down during the attachment or detachment work of the fixing plate 77. Therefore, there is no need of holding the fixing bolt 78 every when the fixing bolt 78 is attached and detached to the opening end of the basket 30H. Thus, this contributes to prevention of a bolt come-down or come-off accident during the work. In addition, safety and reliability relative to the fuel transport can be improved.

An eleventh embodiment shows another modification of the above ninth embodiment. For this reason, a detailed explanation of components, operation or effect and a fuel transport method common to the above ninth embodiment is omitted, and the details of different portions will be described below.

Figure 22:
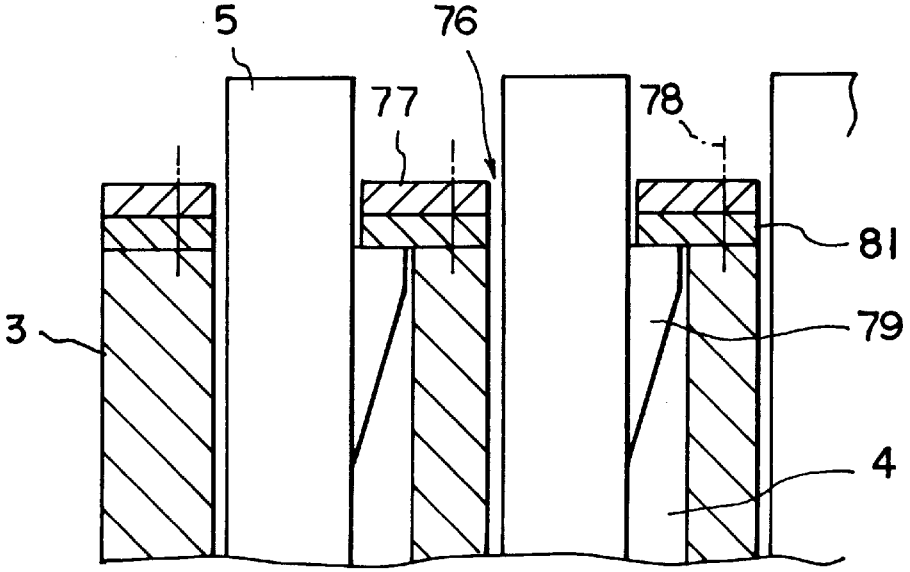
FIG. 22 is a cross-sectional view showing principal parts of a basket an eleventh embodiment of the present invention.

As shown in FIG. 22 which is a cross-sectional view showing principal parts of a basket, a shock absorbing member such as a flat silicon rubber is interposed between the fixing plate 77 which is fixed to the opening end of the basket 30H of the fuel transport container by means of the fixing bolt 78, and the projecting portion 79 provided on the opening end of the basket 3 and the fuel protective container 5. The shock absorbing member 81 has the substantially same shape as the fixing plate 77, and is formed with holes 76 which has the same arrangement as the basket holes 4.

The following is an explanation about an operation and effect obtained from the above construction and a fuel transport method. In a mount process, first, the fuel protective containers 5 are all housed in the basket holes 4, and thereafter, the shock absorbing member 81 is arranged on the end portion of the fuel protective container 5 so as to be abutted against the projecting portion 79 provided on the opening end of the basket 3 and the fuel protective container 5.

Next, the fixing plate 77 is placed on the aforesaid shock absorbing member 81, and then, is pressed against the projecting portion 79 provided on the fuel protective container 5 and the opening end of the basket 30H, and thereafter, the fixing plate 77 is fixed to the basket 30H by means of the fixing bolt 78 together with the shock absorbing member 81.

Whereby the projecting portion 79 provided on the fuel protective container 5 housed in the basket hole 4 is fixedly supported on to the fixing plate 77 via the shock absorbing member 81 together with the opening end of the basket 30H. Therefore, the motion of the fuel protective container 5 is restricted in a axial direction thereof and a direction perpendicular to the axial direction thereof.

In general, in a plurality of fuel protective containers 5 housed in the basket 30H, all upper surfaces of the projecting portions 79 does not always become uniform in its height position, and there is the case where somewhat becomes uniformless.

However, in the eleventh embodiment, the plurality of the aforesaid projecting portions 79 is fixedly supported by the fixing plate 77 via the shock absorbing member 81 in the manner of being pressed against the fixing plate 77. Therefore, a relatively uniform tightly fixing force can be applied to respective fuel protective containers 5.

In a transport process, in the case where the fuel transport container is transported in a state that it is horizontally positioned, the fuel protective containers 5 are all transported in a state of being fixedly supported by a uniform tightly fixing force. Also, other operation or effect is the same as obtained in the above ninth embodiment.

Figure 23:
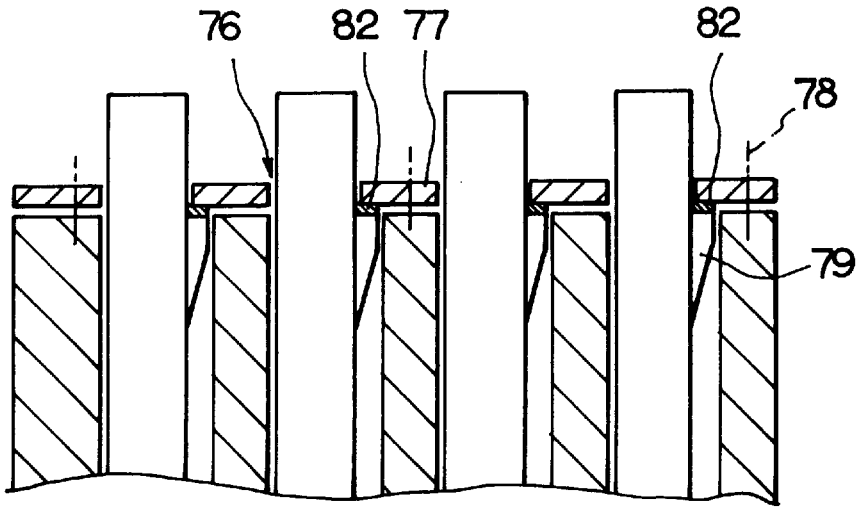
FIG. 23 is a cross-sectional view showing principal parts of a modification of the eleventh embodiment.

Moreover, FIG. 23 is a cross-sectional view showing principal parts of a basket, and shows a modification of the above eleventh embodiment. In FIG. 22, the shock absorbing member 81, which has the substantially same shape as the fixing plate 77, is interposed between the fixing plate 77 and the projecting portion provided on the opening end of the basket 3 and the fuel protective container 5.

On the other hand, in FIG. 23, in place of the aforesaid shock absorbing member 81, a shock absorbing member 82 is provided on an upper surface of the projecting portion 79 provided on the fuel protective container 5. The shock absorbing member 82 has the same as the upper surface of the projecting portion 79 and is made of the same material as the aforesaid shock absorbing member 81. The shock absorbing member 82 is pressed from the top by the fixing plate 77, and thus, the fuel protective container 5 is fixedly supported.

The following is an explanation about an operation and effect obtained from the above construction. By taking advantage of the shock absorbing member 82 smaller than the aforesaid shock absorbing member 81, a plurality of fuel protective containers 5 can be fixedly supported by a relatively uniform tightly fixing force. Other operation and effect is the same as obtained in FIG. 22.

Figure 24:
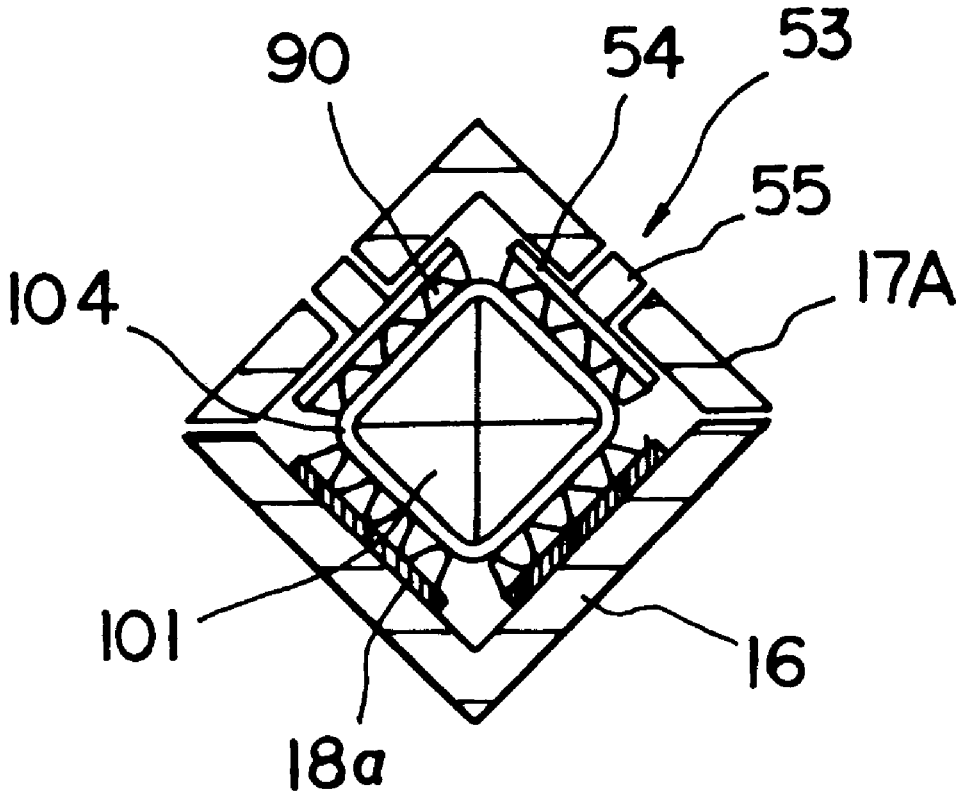
FIG. 24 is a cross sectional view showing a modification of the fuel protective container shown in FIG. 10 to FIG. 13.

FIG. 24 shows a modification of the fuel protective container shown in FIG. 10 to FIG. 13. Now, the modification applied to the fuel protective container 5C shown in FIG. 13 will be described. As shown in FIG. 24, a compressive member 90 such as a plate spring is interposed between the fastening plate 54 of the fastening mechanism 55 provided on the cap member 17A and fuel spacer 104 and between the projective member 18*a* and fuel spacer 104.

In this manner, the fuel spacer 104 is fastened by means of the fastening mechanism 55 via the compressive member 90.

In general, a natural frequency of the fuel assembly 101 varies due to a difference in rigidity between supporting portions (members), that is, the transport separator 110 and the fuel spacer 104 which support the own weight of the fuel rod group.

The rigidity of the fuel spacer 104 is considerably larger than that of the transport separator 110. For this reason, as shown in FIG. 10 to FIG. 13, in the case where the fuel rod group is supported by means of the fuel spacer 104, the natural frequency becomes high. As a result, there is the possibility of resonating with a vibration of means of transport such as engine vehicles.

However, according to the present invention, the fuel rod group is fixedly supported via the compressive member 90 such as a plate spring, the natural frequency of the fuel assembly 101 can be set to a lower value, so that a resonance with means of transport can be avoided.

In addition, in the above embodiments and modifications, the plurality of fuel protective containers each of which has a fuel assembly are housed in the transport container and transported together, but the present invention is not limited to the above construction. That is, one fuel protective container may be housed in the transport container and transported.

Further, in the some embodiments and modifications, one inner peripheral side surface of each of the basket holes are inclined at a predetermined angle of substantially 45° with respect to the bottom surface 2*a* corresponding to the horizontal plane. However, the present invention is not limited the above construction. That is, it is possible to set the inclination angle to desired angles on condition that the groove portion formed by the inner peripheral side surfaces which are closely located to the bottom surface along to the horizontal plane is formed so as to be fit to the corner portion formed by the outer side surfaces of the fuel protective container which are opposite to the inner peripheral side surfaces of the fuel protective container, respectively.

Furthermore, in the above embodiments and modifications, the fuel assembly is housed in the fuel protective container and the fuel protective container is accommodated in the basket of the transport container. However, the present invention is not limited the above construction. That is, it is possible to house the fuel assembly in the basket of the transport container. Moreover, in the above embodiments and modifications, transport container has a basket for housing the fuel protective container. However, the present invention is not limited the above structure. That is, the transport container may have a inner surface to be fit to the fuel protective container or the fuel assembly and fixedly supports the fuel protective container or the fuel assembly by means of the fixedly support means.

While there has been described what is at present considered to be the preferred embodiments and modifications of the present invention. It will be understood that various modifications which are not described yet may be made therein, and it is intended to cover in the appended claims all such modifications as fall within the true spirit and scope of the invention.

What is claimed is:

1. A method of transporting at least one fuel assembly, said method comprising the steps of:

providing a transport container having a basket, said basket including at least one basket hole, said at least one basket hole having four inner side surfaces and an inner surface portion, said four inner side surfaces providing a substantially square-shaped cross section, said inner surface portion being formed by two inner side surfaces of the four inner side surfaces so as to be substantially V-shaped, said at least one fuel assembly having four outer side surfaces and a corner portion, and four outer side surfaces providing a substantially square-shaped cross section, said corner portion being defined by two outer side surfaces of the four outer side surfaces;

housing the at least one fuel assembly in the at least one basket hole of the basket so that the V-shaped inner surface portion of the at least one basket hole is opposite to the corner portion of the at least one fuel assembly; and pushing the at least one fuel assembly against the V-shaped inner surface portion of the at least one basket hole so as to fit the corner portion of the at least one fuel assembly to the V-shaped inner surface portion thereby fixedly supporting the at least one fuel assembly to the at least one basket hole of the basket.

2. A transport container for transporting at least one fuel assembly, the transport container comprising:

container means having a basket including at least one basket hole, said at least one basket hole having four inner side surfaces and an inner surface portion, said four inner side surfaces providing a substantially square-shaped cross section, said inner surface portion being formed by two inner side surfaces of the four inner side surfaces so as to be substantially V-shaped, said at least one fuel assembly having four outer side surfaces and a corner portion, said four outer side surfaces providing a substantially square-shaped cross section, said corner portion being defined by two outer side surfaces of the four outer side surfaces, said at least one fuel assembly being housed in the at least one basket hole so that the four outer side surfaces thereof are opposite to the four inner side surfaces thereof, respectively, and that the V-shaped inner surface portion is opposite to the corner portion; and support means for pushing the at least one fuel assembly against the V-shaped inner surface portion of the at least one basket hole so as to fit the corner portion of the at least one fuel assembly to the V-shaped inner surface portion thereby fixedly supporting the at least one fuel assembly to the at least one basket hole of the basket.

3. A method of transporting at least one fuel protective container, said at least one fuel protective container housing at least one fuel assembly therein, said method comprising the steps of:

providing a transport container having a basket, said basket including at least one basket hole, said at least one basket hole having four inner side surfaces and an inner surface portion, said four inner side surfaces providing a substantially square-shaped cross section, said inner surface portion being formed by two inner side surfaces of the four inner side surfaces so as to be substantially V-shaped, said at least one fuel protective container having four outer side surfaces and a corner portion, said four outer side surfaces providing a substantially square-shaped cross section, said corner portion being defined by two outer side surfaces of the four outer side surfaces;

housing the at least one fuel protective container in the at least one basket hole of the basket so that the V-shaped inner surface portion of the at least one basket hole is opposite to the corner portion of the at least one fuel protective container; and pushing the at least one fuel protective container against the V-shaped inner surface portion of the at least one basket hole so as to fit the corner portion of the at least one fuel protective container to the V-shaped inner surface portion thereby fixedly supporting the at least one fuel protective container to the at least one basket hole of the basket.

4. A method according to claim 3, further comprising the steps of:

mounting first taper portions on bottom end portions of the two remained inner side surfaces of the four inner side surfaces of the at least one of the basket holes projecting toward the two inner side surfaces thereof, respectively, said one of the remained two inner side surfaces being adjacent to other of the remained two inner side surfaces; and mounting a second taper portions on one end portions of two the remained outer side surfaces of the four outer side surfaces of the at least one fuel protective container which are adjacent to an opening end portion of the at least one of the basket holes, whereby other end portions of the remained outer side surfaces of the at least one fuel protective container are guided along the first taper portions of the remained two inner side surfaces of the at least one of the basket holes, respectively and the one end portions of remained outer side surfaces of the at least one fuel protective container are guided along the second taper portions thereof so that the at least one fuel protective container is positioned adjacent to the V shaped inner surface portion.

5. A method according to claim 3, wherein said basket has a substantially cylindrical shape and plurality of the basket holes arranged as a square shape and is divided into a plurality of basket portions in a longitudinal direction of the basket, said providing step includes the step of providing a grid plate having substantially square shaped grid holes of a same arrangement as the plurality of basket holes and interposing the grid plate between at least one adjacent basket portions, said at least one fuel assembly element is housed in at least one of the basket holes and at least one of the grid holes of the grid plate corresponding to the at least one of the basket holes; and wherein said pushing step is comprised of moving the grid plate along a diagonal direction of the at least one of the basket holes toward the V shaped inner surface portion thereof so as to push the at least one fuel protective container against the V shaped inner surface portion.

6. A method according to claim 3, wherein said basket has a substantially cylindrical shape and plurality of the basket holes arranged as a square shape and is divided into a plurality of basket portions in a longitudinal direction of the basket, said providing step includes the step of providing a pair of grid plates arranged so as to face each other each of which has substantially square shaped grid holes of a same arrangement as the plurality of basket holes and of interposing each of said grid plates between at least one adjacent basket portions; said at least one fuel assembly element is housed in at least one of the basket holes and at least one of the grid holes of each of the grid plates corresponding to the at least one of the basket holes; and wherein said pushing step is comprised of moving one of the grid plate along the one of the two inner side surface of the at least one of the basket holes toward the other of the two inner side surface thereof and moving other of the grid plate along the other of the two inner side surface of the at least one of the basket holes toward the one of the two inner side surface thereof so as to push the at least one fuel protective container against the V shaped inner surface portion of the at least one of the basket holes.

7. A method according to claim 3, further comprising the step of arranging the basket in the transport container so that the one of the two inner side surfaces of the at least one basket hole is inclined with respect to a horizontal plane at a predetermined angle, said transport container being positioned along the horizontal plane in order to transport the transport container.

8. A method according to claim 7, further comprising the step of fastening the fuel assembly from an upper side thereof whereby fixedly to support the fuel assembly to the fuel protective container, wherein said the at least one fuel protective container is housed in the at least one basket hole of the basket whereby a fastening direction related to the fastening step is directed downward toward the horizontal plane.

9. A method according to claim 7, wherein said predetermined angle is set as substantially 45°.

10. A method according to claim 9, wherein said transport container is transported with one of the two outer side surfaces which is opposite to the one of the two inner side surfaces of the at least one basket hole kept being inclined to the horizontal plane at substantially 45°.

11. A transport container for transporting at least one fuel protective container, said at least one fuel protective container housing at least one fuel assembly therein, the transport container comprising:

container means having a basket including at least one basket hole, said at least one basket hole having four inner side surfaces and an inner surface portion, said four inner side surfaces providing a substantially square-shaped cross section, said inner surface portion being formed by two inner side surfaces of the four inner side surfaces so as to be substantially V-shaped, said at least one fuel protective container having four outer side surfaces and a corner portion, said four outer side surfaces providing a substantially square-shaped cross section, said corner portion being defined by two outer side surfaces of the four outer side surfaces, said at least one fuel protective container being housed in the at least one basket hole so that the four outer side surfaces thereof are opposite to the four inner side surfaces thereof, respectively, and that the V-shaped inner surface portion is opposite to the corner portion; and support means for pushing the at least one fuel protective container against the V-shaped inner surface portion of the at least one basket hole so as to fit the corner portion of the at least one fuel protective container to the V-shaped inner surface portion thereby fixedly supporting the at least one fuel protective container to the at least one basket hole of the basket.

12. A transport container according to claim 11, wherein, when the transport container is positioned along a horizontal plane in order to transport the transport container, said one of the two inner side surfaces of the at least one basket hole is positioned along the horizontal plane.

13. A transport container according to claim 12, wherein said basket has a substantially cylindrical shape and plurality of the basket holes arranged as a square shape and is divided into a plurality of basket portions in a longitudinal direction of the basket, said support means has a grid plate having substantially square shaped grid holes of a same arrangement as the plurality of basket holes, said grid plate being interposed between at least one adjacent basket portions and said at least one fuel protective container being inserted in at least one of the basket holes and at least one of the grid holes corresponding to the at least one of the basket holes and has a drive device for moving the grid plate along a diagonal direction of the at least one of the basket holes toward the V shaped inner surface portion thereof so as to push the at least one fuel protective container against the V shaped inner surface portion of the at least one of the basket holes thereby fixedly supporting the corner portion of the at least one fuel protective container to the V shaped inner surface portion thereof.

14. A transport container according to claim 12, wherein said basket has a substantially cylindrical shape and plurality of the basket holes arranged as a square shape and is divided into a plurality of basket portions in a longitudinal direction of the basket, said support means has a pair of grid plates arranged so as to face each other each of which has substantially square shaped grid holes of a same arrangement as the plurality of basket holes, each of said grid plates being interposed between at least one adjacent basket portions and said at least one of the fuel protective container being inserted in at least one of the basket holes and at least one of the grid holes corresponding to theat least one of the basket holes and has a drive device for moving one of the grid plate along the one of the two inner side surface of the at least one of the basket holes toward the other of the two inner side surface thereof and moving other of the grid plate along the other of the two inner side surface thereof toward the one of the two inner side surface thereof so as to push the at least one fuel protective container against the V shaped inner surface portion of the at least one of the basket holes thereby fixedly supporting the corner portion of the at least one fuel protective container to the V shaped inner surface portion thereof.

15. A transport container according to claim 11, wherein, when the transport container is positioned along a horizontal plane in order to transport the transport container, said one of the two inner side surfaces of the at least one basket hole is inclined at a predetermined angle with respect to the horizontal plane.

16. A transport container according to claim 15, wherein said predetermined angle is set as substantially 45°.

17. A transport container according to claim 15, further comprising:

first taper portions mounted on bottom end portions of two remained inner side surfaces of the four inner side surfaces of the at least one of the basket holes projecting toward the two inner side surfaces thereof, respectively, said one of the remained two inner side surfaces being adjacent to other of the remained two inner side surfaces; and second taper portions mounted on one end portions of two the remained outer side surfaces of the four outer side surfaces of the at least one fuel protective container which are adjacent to an opening end portion of the at least one of the basket holes, whereby other end portions of the remained outer side surfaces of the at least one fuel protective container are guided along the first taper portions of the remained two inner side surfaces of the at least one of the basket holes, respectively and the one end portions of remained outer side surfaces of the at least one fuel protective container are guided along the second taper portions thereof so that the at least one fuel protective container is positioned adjacent to the V shaped inner surface portion.

18. A transport container according to claim 15, wherein said basket has a substantially cylindrical shape and plurality of the basket holes arranged as a square shape and is divided into a plurality of basket portions in a longitudinal direction of the basket, said support means has a pair of grid plates arranged so as to face each other each of which has substantially square shaped grid holes of a same arrangement as the plurality of basket holes, each of said grid plates being interposed between at least one adjacent basket portions and said at least one fuel protective container being inserted in at least one of the basket holes and at least one of the grid holes of each of the grid plates corresponding to the at least one of the basket holes and has a drive device for moving one of the grid plate along the one of the two inner side surface of the at least one of the basket holes toward the other of the two inner side surface thereof and moving other of the grid plate along the other of the two inner side surface thereof toward the one of the two inner side surface thereof so as to push the at least one fuel protective container against the V shaped inner surface portion of the at least one of the basket holes thereby fixedly supporting the corner portion of the at least one fuel protective container to the V shaped inner surface portion thereof.

19. A transport container according to claim 15, wherein said support means is located so as to be interposed between remained two outer side surfaces of the four outer side surfaces of the at least one fuel protective container and remained two inner side surfaces of the four inner side surfaces of the at least one basket hole and is in contact with the remained two outer side surfaces and the remained two inner side surfaces so as to push the at least one protective container against the V shaped inner surface portion thereby fixedly supporting the corner portion of the at least one fuel protective container to the V shaped inner surface portion thereof.

20. A transport container according to claim 19, wherein said support means has at least one of a spring member, a protrusion member having a shape which is easy to be slid a rotating member.

21. A transport container according to claim 15, wherein said basket has a substantially cylindrical shape and plurality of the basket holes arranged as a square shape and is divided into a plurality of basket portions in a longitudinal direction of the basket, said support means has a grid plate having substantially square shaped grid holes of a same arrangement as the plurality of basket holes, said grid plate being interposed between at least one adjacent basket portions and said at least one fuel protective container being inserted in at least one of the basket holes and at least one of the grid holes corresponding to the at least one of the basket holes and has a drive device for moving the grid plate along a diagonal direction of the at least one of the basket holes toward the V shaped inner surface portion thereof so as to push the at least one fuel protective container against the V shaped inner surface portion of the at least one of the basket holes thereby fixedly supporting the corner portion of the at least one fuel protective container to the V shaped inner surface portion thereof.

22. A transport container according to claim 21, wherein said drive device is provided with a pair of two drive mechanisms so attached onto an upper side portion of the grid plate as to structurally symmetrical for moving the grid plate along the diagonal direction and with driving means operatively connected to the two drive mechanisms for driving the two-system drive mechanisms simultaneously so as to move the grid plate by a fixed displacement along the diagonal direction whereby the corner portion of the at least one fuel protective container is fixedly supported to the V shaped inner surface portion.

* * * * *